US005283158A

United States Patent [19]

Onodera et al.

[11] Patent Number: 5,283,158

[45] Date of Patent: Feb. 1, 1994

[54] SILVER HALIDE PHOTOGRAPHIC LIGHT-SENSITIVE MATERIAL

[75] Inventors: Akira Onodera; Yasushi Usagawa, both of Hino, Japan

[73] Assignee: Konica Corporation, Tokyo, Japan

[21] Appl. No.: 962,888

[22] Filed: Oct. 19, 1992

[30] Foreign Application Priority Data

Oct. 31, 1991 [JP] Japan ..... 3-286619
Feb. 20, 1992 [JP] Japan ..... 4-33451

[51] Int. Cl.[5] ..... G03C 1/06

[52] U.S. Cl. ..... 430/264; 430/487; 430/598; 430/566

[58] Field of Search ..... 430/264, 487, 598, 566

[56] References Cited

U.S. PATENT DOCUMENTS 4,914,003 4/1990 Yagihara et al. ..... 430/264
4,965,169 10/1990 Hirano et al. ..... 430/264
4,975,354 12/1990 Machonkin et al. ..... 430/264
5,030,547 7/1991 Katoh et al. ..... 430/264

FOREIGN PATENT DOCUMENTS 3203661 9/1982 Fed. Rep. of Germany .

*Primary Examiner*—Charles L. Bowers, Jr.
*Assistant Examiner*—Thomas R. Neville
*Attorney, Agent, or Firm*—Jordan B. Bierman

[57] ABSTRACT

Disclosed is a silver halide photographic light-sensitive material comprising a support having thereon at least one silver halide emulsion layer, a hydrazine compound is contained in said silver emulsion layer or at least one of other layers, wherein said material contains at least one compound represented by Formula I or Formula II, Formula I wherein $R_1$ and $R_2$ each independently represent an alkyl group, an alkenyl group or an alkynyl group respectively; $R_1$ and $R_2$ may form a ring; $R_3$ represents a hydrogen atom, an alkyl group, an alkenyl group, an alkynyl group, an aryl group or a heterocyclic group; $L_1$ represents a divalent linking group; X represents a —[S—$L_2$—Y—($L_3$)n]— group or a [—($L_3$)n—Y—$L_2$—S—]— group, $L_2$ represents an alkylene group or an alkenylene group, Y represents a carbonyl group, a sulfonyl group, a sulfoxy group, a phosphoryl group, $L_3$ represents wherein $Z_1$, $Z_2$ and $Z_3$ each independently represent a hydrogen atom, an alkyl group, an alkenyl group, an alkynyl group, an aryl group or a heterocyclic group; n is an integer of 0 to 1;

Formula II wherein R4, R5 and $R_6$ each independently represent an alkyl group, an alkenyl group or an alkynyl group, further Formula II comprises a thioether structure and a —O—Y)$_l$ structure, Y represents an alkylene group, an alkenylene group or an arylene group, l is an integer of 2 or more.

The silver halide photographic light-sensitive material is capable offering high contrast.

7 Claims, No Drawings

SILVER HALIDE PHOTOGRAPHIC LIGHT-SENSITIVE MATERIAL

FIELD OF THE INVENTION

The present invention relates to a photographic light-sensitive material comprising a support having thereon silver halide light-sensitive layers, and more particularly to a silver halide photographic light-sensitive material capable of offering high contrast.

BACKGROUND OF THE INVENTION

In a photographic plate-making process, a step to convert a document with continuous gradation to dot images is included. For this step, a technology employing infectious development has been used as a photographic technology capable of offering super high contrast image reproduction.

Litho-type silver halide photographic light-sensitive materials used for infectious development are, for example, composed of silver bromochloride emulsion having an average grain size of 0.2 μm and high silver chloride content ratio (at least 50 mol % or more) wherein grain size distribution is narrow and the shape of grain is uniform. By processing the above-mentioned litho-type silver halide photographic light-sensitive material with an alkaline hydroquinone developing solution with low sulfite ion density, images having high contrast, high sharpness and high resolution can be obtained.

However, since the above-mentioned litho-type developing solutions are subjected to air oxidation, it is extremely inferior in preservability. Therefore, it is also difficult to keep the quality of development constant in continuous use.

Methods for obtaining images having high contrast rapidly without employing the above-mentioned litho-type developing solutions are known. As shown in U.S. Pat. No. 2,419,975 and Japanese Patent Publication Open to Public Inspection (hereinafter, referred to as Japanese Patent O.P.I. Publication) Nos. 16623/1976, 20921/1976 and 106244/1981, it represents a method to contain hydrazine derivatives in silver halide light-sensitive materials.

Due to the above-mentioned method, sulfite ion density in a developing solution can be kept high and processing can be conducted while keeping high preservability.

However, in the above-mentioned method, processing had to be conducted with developing solution having pH of 11 or more in order to utilize the high contrast property of hydrazine derivatives to a full extent. Though developing solutions having pH of 11 or more is more stable than a litho-type developing wherein the developing agent is easily oxidized when it is exposed to air, it often fails to offer super high contrast images due to the oxidation of developing agent.

In order to complement the above-mentioned defect, silver halide photographic light-sensitive materials containing nucleating agents which make images contrast-increasing even in a developing solution with relatively low pH are disclosed in Japanese Patent O.P.I. Publication No. 29751/1988 and European Patent Nos. 333,435 and 345,025.

However, when silver halide photographic light-sensitive materials containing the above-mentioned nucleating agents are processed with developing agent having pH of less than 11, it is the present situation that contrast-increase is incomplete and satisfactory dot properties cannot be obtained.

On the other hand, in European Patent No. 364,166 and Japanese Patent O.P.I. Publication Nos. 222241/1987, 140340/1985, 250439/1987 and 280733/1987, contrast-promoting compounds for accelerating contrast-increase are described. It is sure that dot properties are improved by adding the above-mentioned compounds into emulsion layers. However, it turned out that a problem of sand-like and pinhole-like fogging in dots, so-called pepper fog, occurred damaging the quality of dot images.

Therefore, there has been demanded a light-sensitive material solving the above-mentioned problems and employing effective nucleating agents and contrast-promoting compounds.

SUMMARY OF THE INVENTION

The object of the present invention is to provide a silver halide photographic light-sensitive material showing preferable dot properties by inhibiting fog occurrence in dot images as well as high-contrast photographic properties even processed with a developing solution with pH of less than 11.

The above-mentioned object of the present invention was attained by a silver halide photographic light-sensitive material having the following structure. A silver halide photographic light-sensitive material comprising a support having thereon at least one silver halide emulsion layer, said silver halide emulsion or at least one of other structural layers containing a hydrazine compound, wherein at least one of compounds represented by the following Formula I or II is contained.

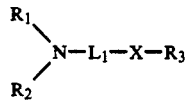

Formula I wherein $R_1$ and $R_2$ each independently represent an alkyl group, an alkenyl group or an alkynyl group respectively; $R_1$ and $R_2$ may form a ring; $R_3$ represents a hydrogen atom, an alkyl group, an alkenyl group, an alkynyl group, an aryl group or a heterocyclic group; $L_1$ represents a divalent linking group; X represents $$\text{-}[S-L_2-Y-(L_3)_n]\text{ group or }-(L_3)_nY-L_2-S]\text{-}$$

group;

$L_2$ represents an alkylene group or an alkenylene group; Y represents a carbonyl group, a sulfonyl group, a sulfoxy group and a phosphoryl group; $L_3$ represents $$-O-,\ -\overset{Z_1}{\overset{|}{N}}-,\ -\overset{Z_2}{\overset{|}{N}}-\overset{Z_3}{\overset{|}{N}}-$$

$Z_1$, $Z_2$ and $Z_3$ each independently represent a hydrogen atom, an alkyl group, an alkenyl group, an alkynyl group, an aryl group or a heterocycle; n represents 0 or 1.

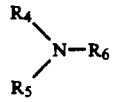

Formula II wherein $R_4$, $R_5$ and $R_6$ each independently represent an alkyl group, an alkenyl group and an alkynyl group.

However, compounds having Formula II have a partial structure of thioether and $$-O-Y)_l$$

Y represents a substitutable alkylene group, a substitutable alkenylene group or a substitutable arylene group; l represents an integer of 2 or more.

(2) The silver halide photographic light-sensitive material described in (1) wherein hydrazine compounds described in (1) are represented by the following Formula IV.

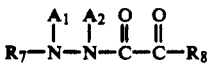

Formula IV wherein $R_7$ represents an aryl group or a heterocycle; $R_8$ represents

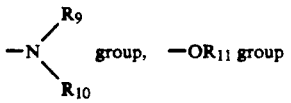

$R_9$ and $R_{10}$ represent a hydrogen atom, an alkyl group, an alkenyl group, an alkynyl group, an aryl group, a heterocycle, an amino group, a hydroxyl group, an alkoxy group, an alkenyloxy group, an alkinyloxy group, an aryloxy group or a heterocyclic oxy group; $R_{11}$ represents a hydrogen atom, an alkyl group, an alkenyl group, an alkynyl group, an aryl group or a heterocycle; both $A_1$ and $A_2$ both represent hydrogen atoms, or one of them is a hydrogen atom while the other of them is an acyl group, a sulfonyl group or an oxalyl group.

DETAILED DESCRIPTION OF THE PREFERRED EMBODIMENT

Hereunder, we will explain the present invention in detail.

In Formula I, as groups represented by $R_1$ and $R_2$, alkyl groups (for example, a methyl group, an ethyl group, a propyl group, an isopropyl group, a butyl group, an octyl group and a dodecyl group), alkenyl groups (for example, an allyl group and a butenyl group), alkynyl groups (for example, a propargyl group and a butynyl group) are cited. The above-mentioned groups may further be substituted with substituents (for example, an aryl group, an alkoxy group, an aryloxy group, a hydroxyl group, an alkylthio group, an arylthio group, a sulfonamide group, a carbonamide group, an ureido group, a sulfamoyl group, a carbamoyl group, an amino group, an alkoxycarbonyl group and a carboxyl group). $R_1$ and $R_2$ may be combined to form a ring (for example, a piperidine, a piperazine, a morpholine and a pyrrolidine). As $R_1$ and $R_2$, alkyl groups are preferable and those having 2 to 20 carbons are most preferable.

As groups represented by $R_3$, alkyl groups (for example, a methyl group, an ethyl group, a propyl group, a t-butyl group, an octyl group and a dodecyl group), alkenyl groups (for example, an allyl group and a butenyl group), alkynyl groups (for example, a propargyl group and a butynyl group), aryl groups (for example, a phenyl group and a naphtyl group) or a heterocycles (for example, a thienyl group, a furyl group and a pyridyl group).

The above-mentioned groups may further be substituted with the same substituents as explained in $R_1$ and $R_2$.

$L_1$ represents a divalent linking group, and preferably a group having a substitutable alkylene group (provided that said alkylene combines with

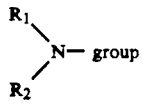

Of divalent linking groups represented by $L_1$, the preferable are alkylene groups having 1 to 10 carbons and groups formed in combination of an alkylene group having 1 to 10 carbons and a group illustrated as follows;

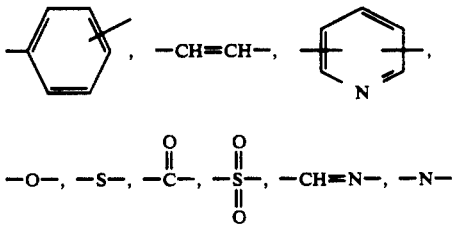

($Z_4$ : a hydrogen atom, an alkyl group and an aryl group)

X represents $$-S-L_2-Y-L_3)_n]\ \text{group}\ [(L_3)_nY-L_2-S-\ \text{group}$$

$L_2$ represents an alkylene group (for example, a methylene group, an ethylene group, a propylene group and a butylene group) or an alkenylene group (for example, a propenylene group and a butenylene group); preferable $L_2$ is an alkylene group having 1 to 4 carbons and more preferable $L_2$ is a methylene group and an ethylene group; Y represents a carbonyl group, a sulfonyl group, a sulfoxy group or a phosphoryl group and preferably a carbonyl group or a sulfonyl group; $L_3$ represents

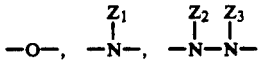

$Z_1$, $Z_2$ and $Z_3$ each independently represent a hydrogen atom, an alkyl group, an alkenyl group, an alkynyl group, an aryl group or a heterocycle. $Z_1$, $Z_2$ and $Z_3$ are each independently preferable to be a hydrogen atom, an alkyl group or an aryl group.

n represents 0 or 1.

Hereunder, we will show practical examples of the compounds represented by Formula I. However, it should be understood that the present invention is by no means restricted to such specific examples.

I-1
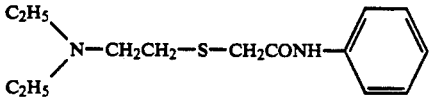
I-2
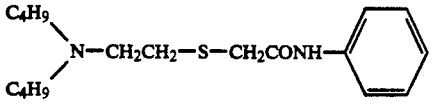
I-3
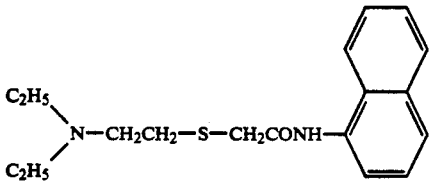
I-4
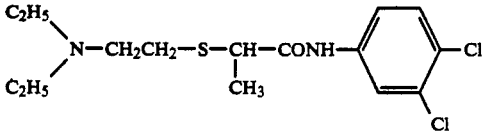
I-5
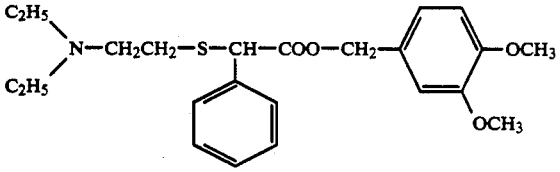
I-6
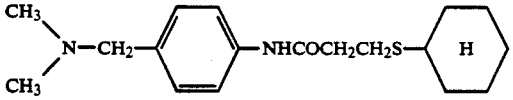
I-7
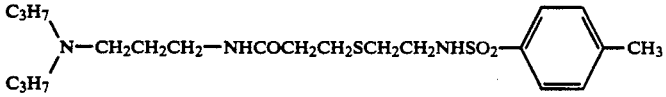
I-8
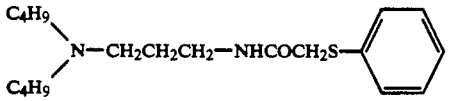
I-9
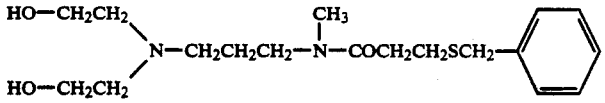
I-10
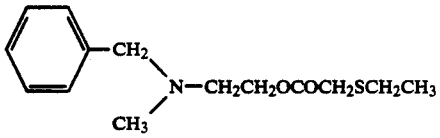
I-11
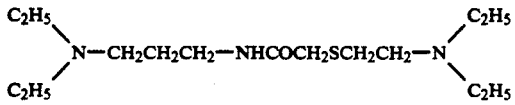
I-12
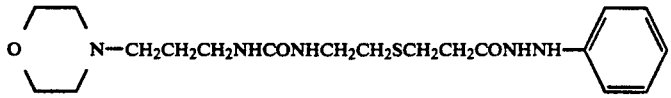

-continued
I-13
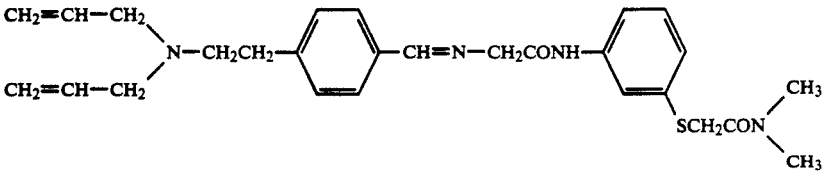
I-14
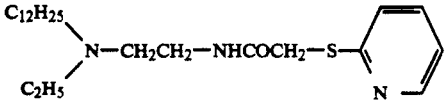
I-15
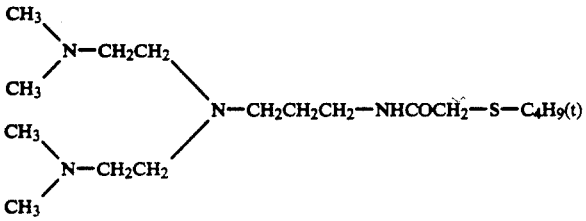
I-16
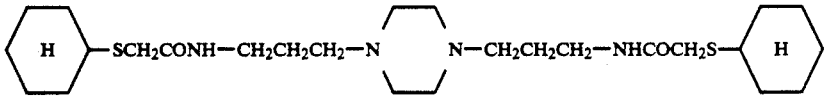
I-17
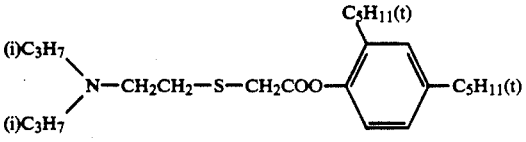
I-18
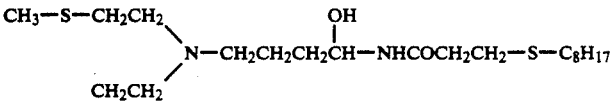
I-19
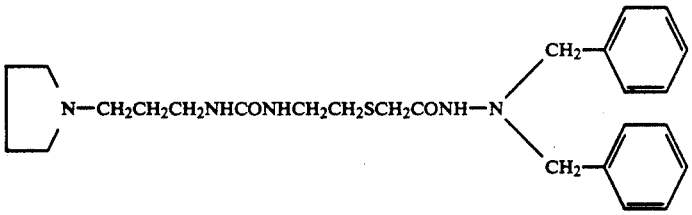
I-20
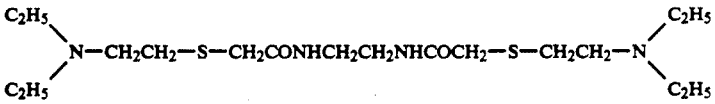
I-21
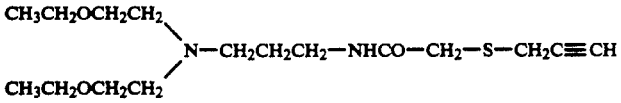
I-22
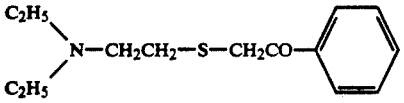
I-23
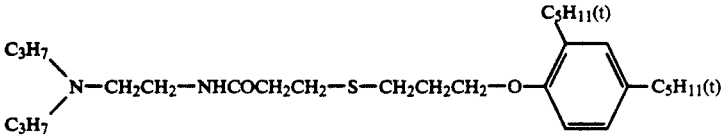

-continued
I-24
$$(C_2H_5)_2N-CH_2CH_2-O-CH_2CH_2-S-CH_2-CONH-CH_2CH_2CH_2-N(C_2H_5)_2$$
I-25
$$(C_3H_7)_2N-CH_2CH_2CH_2-NHCOCONH-CH_2CH_2-S-CH_2COO-CH_2CH_2-OC_2H_5$$
I-26
$$(C_4H_9)_2N-CH_2CH_2CH_2CH_2-S-CH_2CH(CH_3)-CONH-C_{18}H_{37}$$
I-27
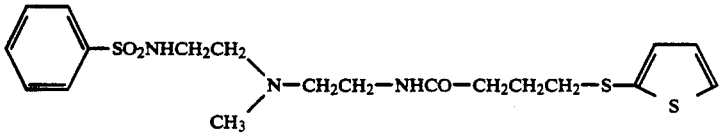
I-28
$$(C_2H_5)_2N-CH_2CH_2-NHCO-CH_2-S-CH_2CH_2-S-CH_2-CONH-CH_2CH_2-N(C_2H_5)_2$$
I-29
$$(C_2H_5)_2N-CH_2CH_2-S-CH_2CONH-CH_2CH_2-O-CH_2CH_2-O-CH_2CONH-CH_2CH=CH_2$$
I-30
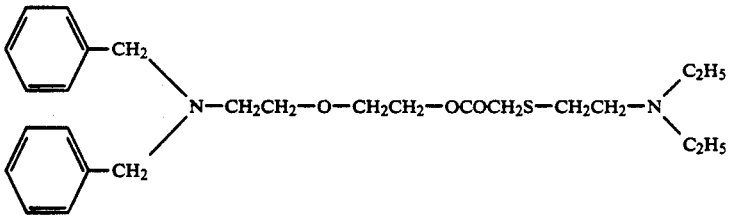
I-31
$$(C_2H_5)_2N-CH_2CH_2CH_2-NHCOCH_2-S-CH_2CONH-CH_2CH_2CH_2-N(C_2H_5)_2$$
I-32
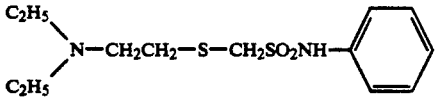
I-33
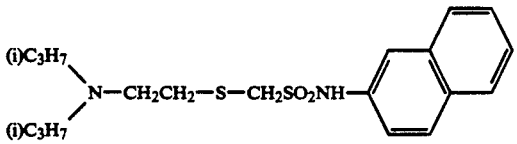
I-34
$$(C_2H_5)_2N-CH_2CH_2-S-CH_2SO_2NH-CH_2CH_2-NHSO_2CH_2-S-CH_2CH_2-N(C_2H_5)_2$$
I-35
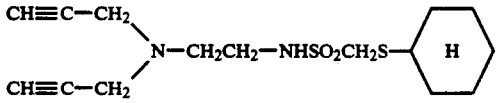

-continued
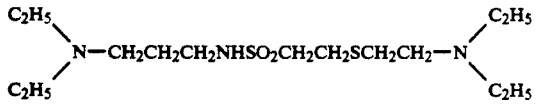
I-36
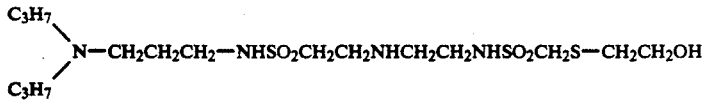
I-37
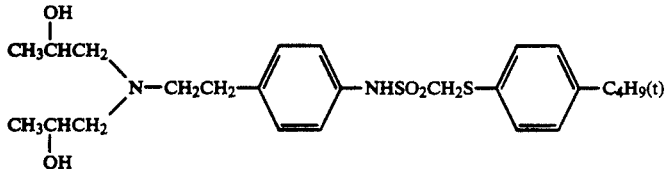
I-38
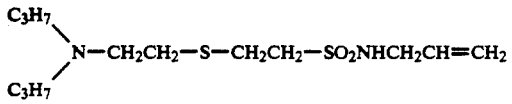
I-39
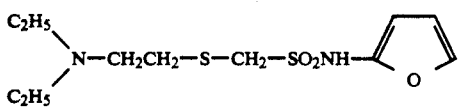
I-40
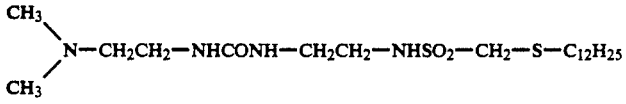
I-41
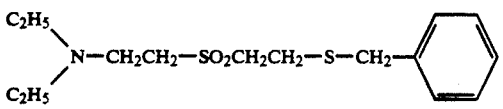
I-42
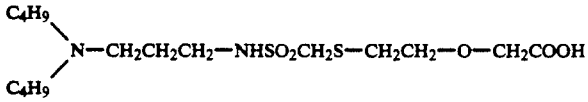
I-43
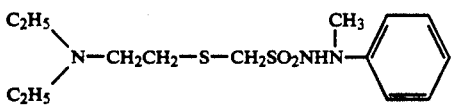
I-44
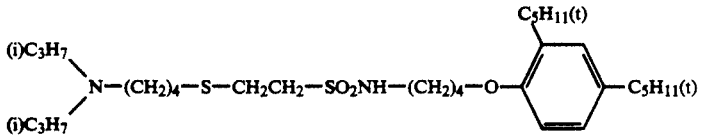
I-45
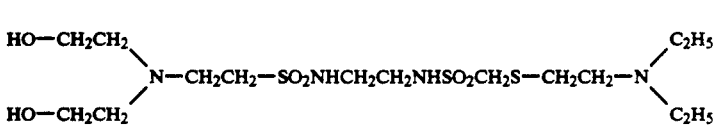
I-46
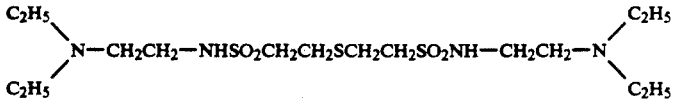
I-47

-continued

I-48

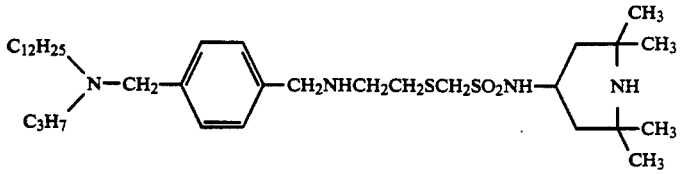

I-49

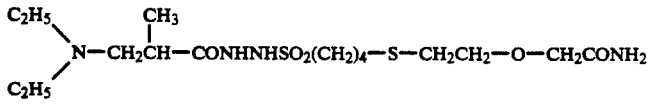

I-50

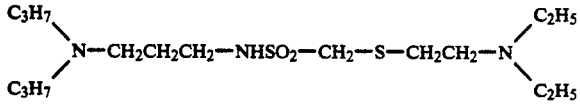

I-51

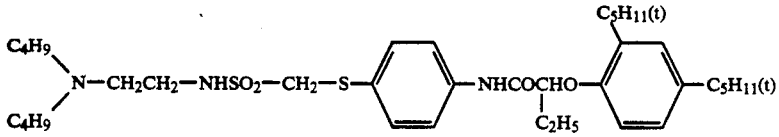

I-52

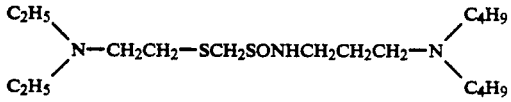

I-53

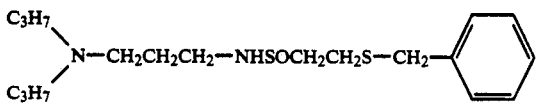

I-54

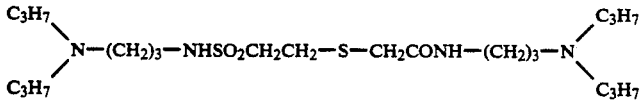

I-55

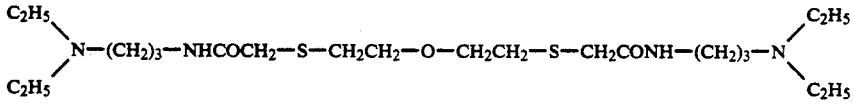

I-56

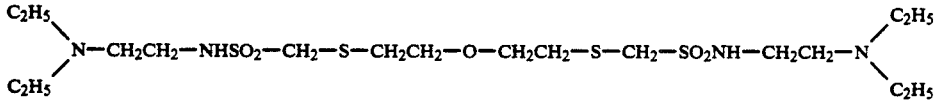

I-57

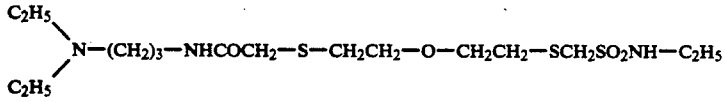

I-58

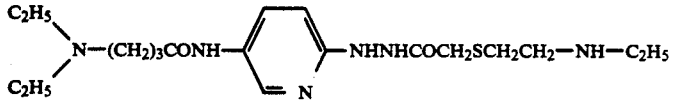

Next, we will show how to obtain and how to synthesize compounds illustrated by the following Formula I.

How to obtain compound I-2

Compound I-2 is available from BADER Co., Ltd. through the market (the catalogue number is S42233-9).

How to obtain compound I-4

Compound I-4 is available from BADER Co., Ltd. through the market (the catalogue number is S42128-6).

Synthesis of compound I-3

Compound I-3 can be synthesized in accordance with the following synthetic method.

I-3

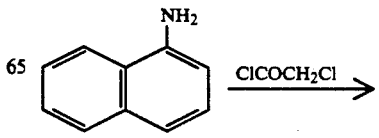

-continued

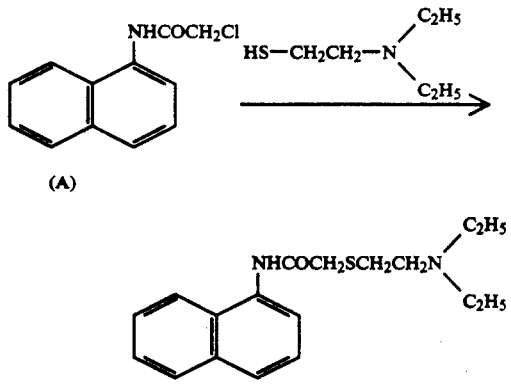

After 7 g of 1-naphthylamine and 280 ml of acetic acid were mixed, 4.64 g of pyridine was added thereto. While the solution was chilled by means of ice water bath, 7.21 g of chloroacetyl chloride was dropped thereon. Then, the solution was agitated for 30 minutes at room temperature. After adding 200 ml of water, the solution was agitated for 5 minutes. Then, coagulated crystals were filtrated out. After this crude crystals were dispersed with 100 ml of isopropylether for 10 minutes, they were filtrated out. Thus, compound (A) was obtained.

The amount obtained was 6.14 g (the yield was 57%) White crystal

After 3.87 g of diethylaminoethanetiol-hydrochloride and 100 ml of ethanol were mixed, 1.82 g of sodium hydroxide was added thereto while the solution was agitated at room temperature. Then, the solution was agitated for 20 minutes. To the solution, 5 g of compound (A) synthesized in the above-mentioned manner was added. Then, the solution was agitated for 2 hours at the internal temperature of 50° C. To the solution, 100 ml of sodium hydroxide aqueous solution having pH of 13 was added. Then, the solution was extracted 3 times with 50 ml of isopropylether. The obtained organic layer was extracted 4 times with 200 ml of hydrochloric acid aqueous solution having pH of 1, and the water layer was extracted 4 times with 200 ml of isopropylether after its pH was adjusted to 13 with sodium hydroxide. After the organic layer was washed twice with 500 ml of water, the solvent was removed. The obtained oil product was refined by means of silica gel column chromatography (Wakogel C-200, chloroform-methanol (10/1)). Thus, compound I-3 was obtained.

The amount obtained was 5.59 g (the yield was 77%) White amorphous solid

Synthesis of compound I-11

Compound I-11 can be synthesized in accordance with the following synthesis scheme.

I-11

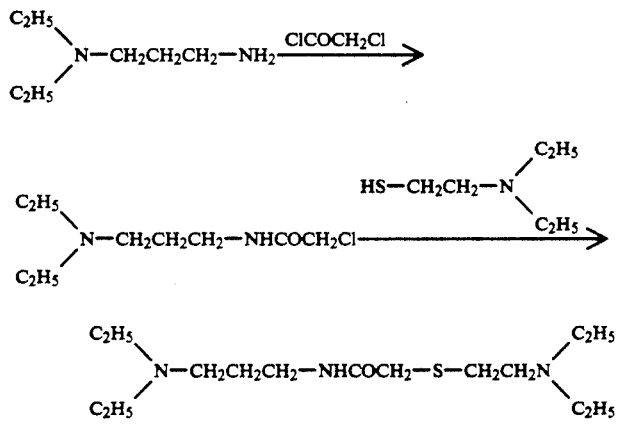

Synthesis of compound I-12

Compound I-12 can be synthesized in accordance with the following synthesis scheme.

I-12

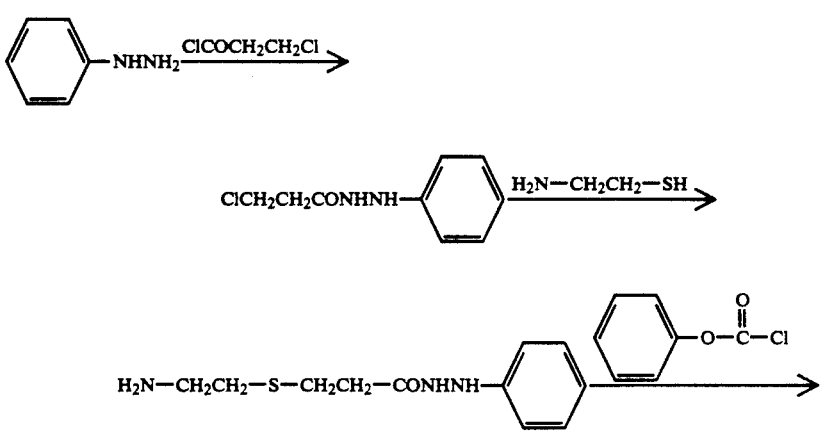

-continued

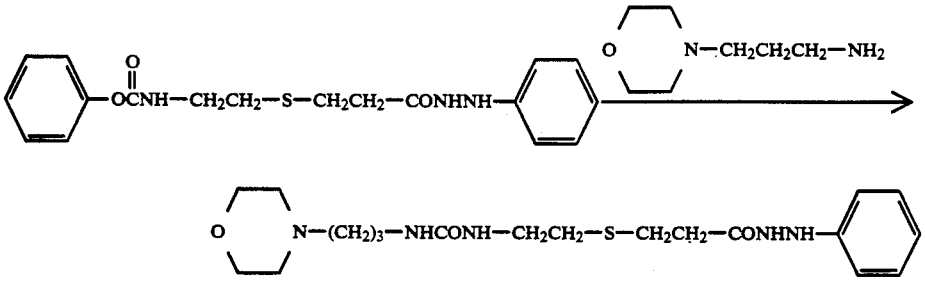

Synthesis of compound I-17

Compound I-17 can be synthesized in accordance with the following synthesis scheme.

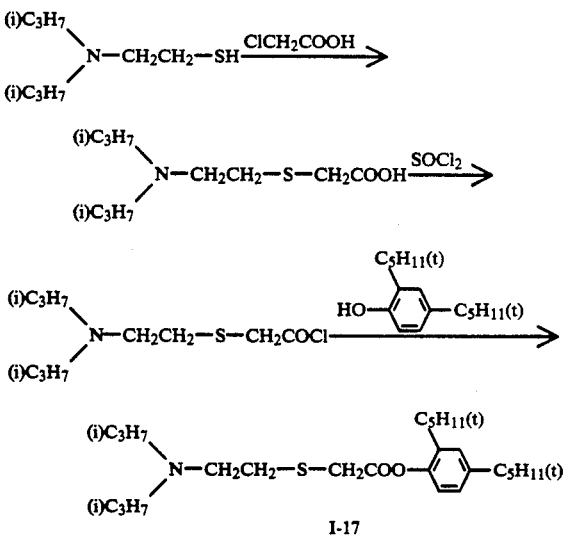

Synthesis of compound I-20

Compound I-20 can be synthesized in accordance with the following synthesis scheme.

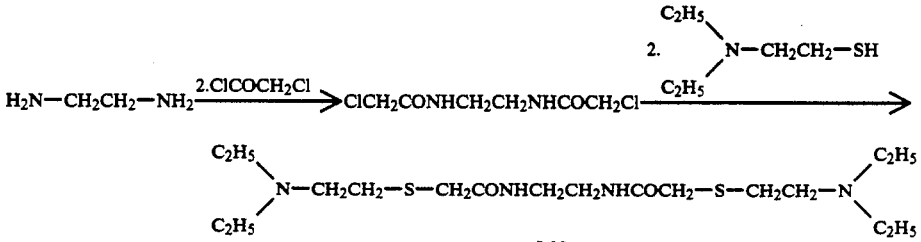

Synthesis of compound I-22

Compound I-22 can be synthesized in accordance with the following synthesis scheme.

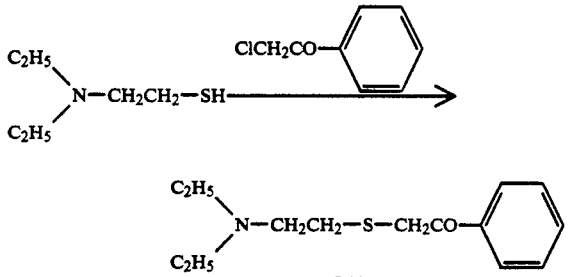

Synthesis of compound I-34

Compound I-34 can be synthesized in accordance with the following synthesis scheme.

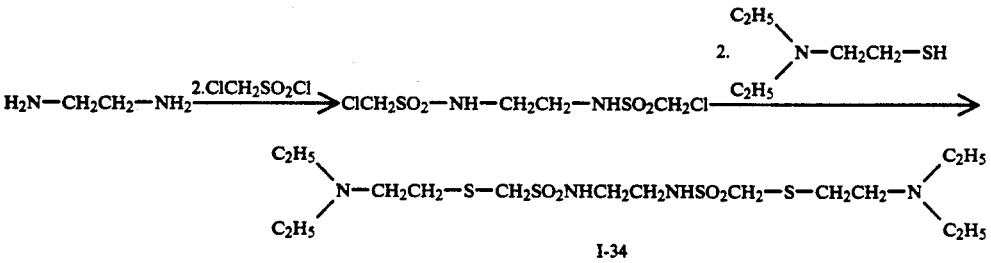

Synthesis of compound I-44

Compound I-44 can be synthesized in accordance with the following synthesis scheme.

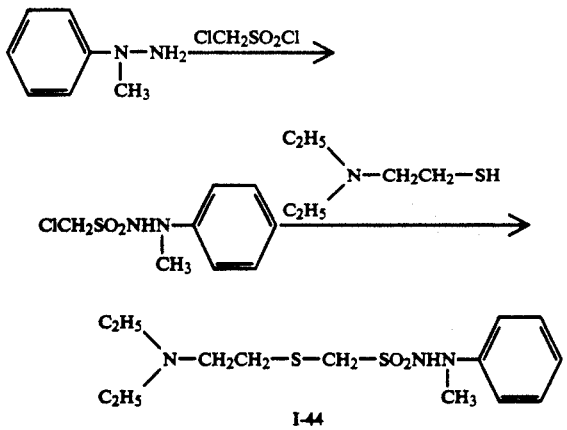

I-44

In Formula II, $R_4$ and $R_5$ each independently represent an alkyl group (for example, a methyl group, an ethyl group, a propyl group, an isopropyl group, a butyl group, an octyl group and a dodecyl group), an alkenyl group (for example, an allyl group, a 2-methylallyl group and a butenyl group), or an alkynyl group (for example, a propargyl group and a butynyl group). They may be substituted with substituents (for example, an alkyl group, an aryl group, an alkoxy group, an aryloxy group, a hydroxyl group, an alkylthio group, an arylthio group, a sulfonamide group, a carbonamide group, an ureido group, a sulfamoyl group, a carbamoyl group, an amino group, an alkoxycarbonyl group and a carboxyl group). $R_4$ and $R_5$ may be combined to form a ring (for example, a piperidine, a piperadine, a morpholine and a pyrrolidine). As $R_4$ and $R_5$, an alkyl group and an alkenyl group are preferable and an alkyl group having 2 to 20 carbons and an alkenyl group having 3 to 20 carbons are most preferable.

$R_6$ represents, an alkyl group (for example, a methyl group, an ethyl group, a propyl group, a butyl group, an octyl group and a dodecyl group), an alkenyl group (for example, an allyl group and a butenyl group), an alkynyl group (for example, a propargyl group and a butynyl group), an aryl group (for example, a phenyl group and a naphtyl group) or a heterocyclic group (for example, a thienyl group, a furyl group and a pyridyl group).

They may be substituted with the same substituents as explained in $R_4$ and $R_5$.

Of the above-mentioned Formula II, the preferable are compounds illustrated by the following Formulas II-A and II-B.

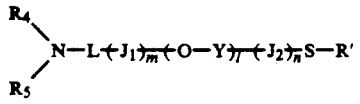

II-A

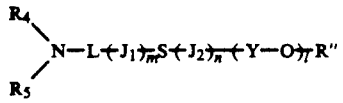

II-B wherein $R_4$, $R_5$, Y and l represent the same groups as those in Formula II; L represents a divalent aliphatic group; $J_1$ and $J_2$ represent a divalent linking groups; m and n represent 0 or 1; R' represents an aliphatic group, an aromatic group or a heterocycle, R'' represents a hydrogen atom, an aliphatic group, an aromatic group or a heterocyclic group.

As divalent aliphatic groups represented by L, an alkylene group (preferably having 1 to 20 carbons) and an alkenylene group (preferably having 3 to 20 carbons); as L, an alkylene groups is preferable and an alkylene group having 2 to 10 carbons is more preferable;

As L, an ethylene group, a trimethylene group and a tetramethylene group are most preferable;

L may be substituted by appropriate substituents (for example, an alkyl group and an aryl group);

As divalent linking groups represented by $J_1$ and $J_2$, the following groups, groups composed of the combination of the following groups and substituents appropriate therefor (for example, an alkyl group, an alkenyl group, an alkynyl group, an aryl group, a heterocycle, a heterocyclic onium group, an amino group, an ammonium group, an acylamino group, a carbamoyl group, a sulfonamide group, a sulfamoyl group, an ureido group, an alkoxy group, an aryloxy group, a heterocyclic oxy group, a hydroxyl group, an alkoxycarbonylamino group, an alkylthio group, an arylthio group, a heterocyclic thio group, a sulfonyl group, a sulfinyl group, a halogen atom, a cyano group, a sulfo group, a carboxyl group, an acyloxy group, an acyl group, an alkyloxycarbonyl group, an aryloxycarbonyl group, a nitro group, a thioacyl group, a thioacylamino group and a thioureido group) are; —$CH_2$—, —CH=CH—, —$C_6H_4$—, pyridinediyl, —N($Z_1$)— ($Z_1$ represents a hydrogen atom, an alkyl group or an aryl group), —O—, —S—, —CO—, —$SO_2$, —CH=N—;

m and n represent 0 or 1 independently, though both of them are preferable to be 0;

Y represents an alkylene group (for example, an ethylene group, a propylene group, a trimethylene group and a tetramethylene group), an alkenylene group (for example, a vinylene group, a propenylene group, a 1-butenylene and a 2-butenylene group) and groups having appropriate substituents therefor (for example, as appropriate substituents contained in $J_1$ and $J_2$, those mentioned above);

Y is preferable an alkylene group, and more preferable an ethylene group, a propylene group and a trimethylene group;

As aliphatic groups independently represented by R' and R'', a straight-chained, branch-chained or ring alkyl group, alkenyl group or alkynyl group (preferably, an alkyl group having 1 to 20 carbons at alkyl group, an alkenyl group having 2 to 20 carbons at alkenyl group and an alkynyl group having 2 to 20 carbons) are cited;

As aromatic groups independently represented by R' and R'', aryl groups of mono-ring (for example, benzene) or condensed ring (for example, naphthalene) are preferable;

As heterocyclic groups independently represented by R' and R'', heterocyclic groups of mono-ring or condensed ring containing at least a hetero atom selected from nitrogen, sulfur and oxygen are preferable, and 5-membered groups (for example, pyrrole, thiophene, furan, imidazole, pyrazole, thiazole, oxazole, thiadiazole, oxadiazole, pyrroline, pyrrolidine, imidazoline, pyrazolidine and tetrahydrofuran), 6-membered groups (for example, pyridine, pyrazine, pyrimidine, pyridazine, triazine, dithin, dioxane, piperidine, morpholine and quinuclidine) and groups of condensed ring between the above-mentioned groups and a cycloalkyl ring (for example, cyclopentane, cyclohexane and cycloheptane), a cycloalkenyl ring (for example, cyclopentene, cyclohexane and cycloheptene), an aromatic ring (for, example, benzene and naphthalene) and a heterocycle (for example, pyrrole, imidazole, pyridine, pyrazine and pyrimidine).

Next, we will show practical examples of compounds illustrated by Formula II in the present invention.

II-1

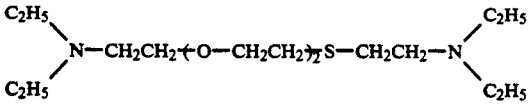

II-2

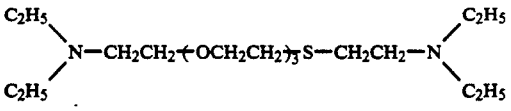

II-3

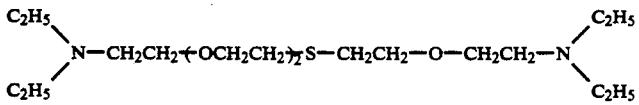

II-4

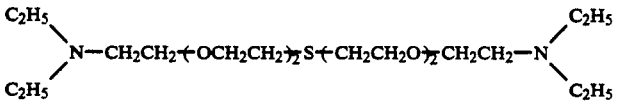

II-5

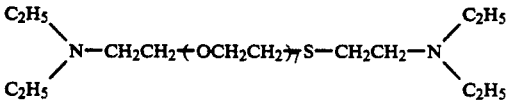

II-6

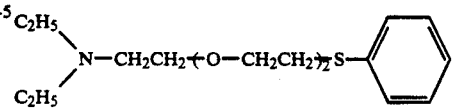

II-7

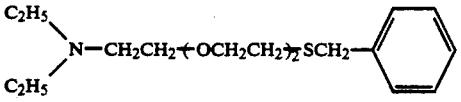

II-8

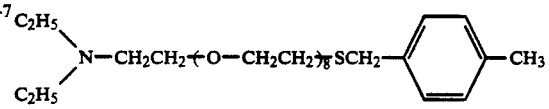

II-9

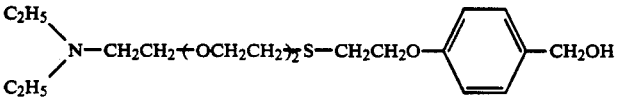

II-10

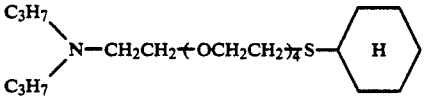

II-11

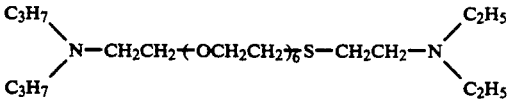

II-12

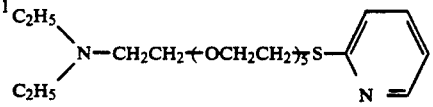

II-13

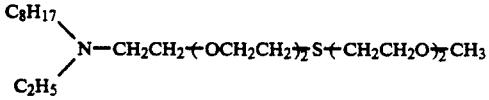

II-14

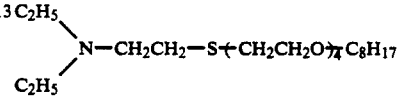

II-15

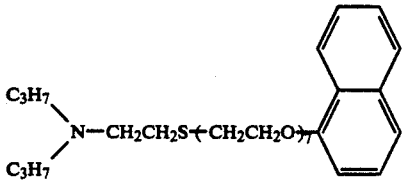

II-16

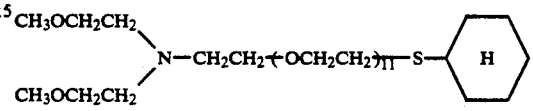

II-17

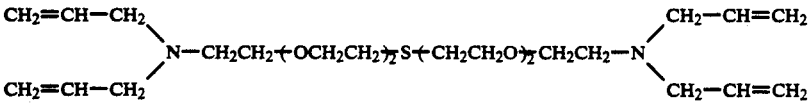

II-18

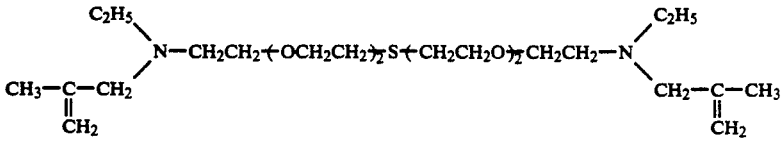

-continued
II-19
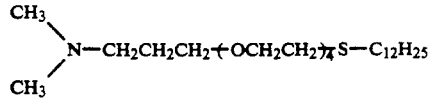
II-20
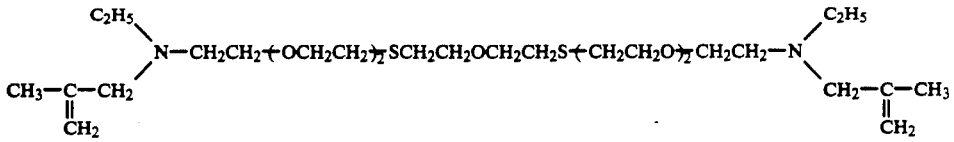
II-21
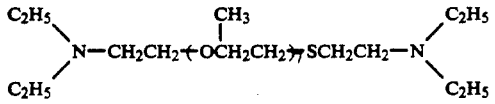
II-22
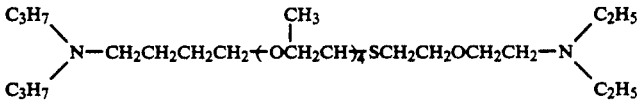
II-23
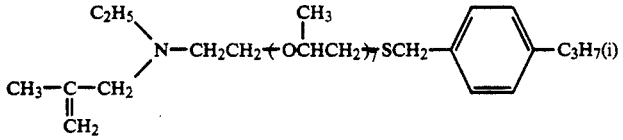
II-24
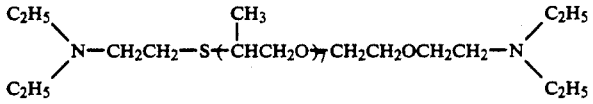
II-25
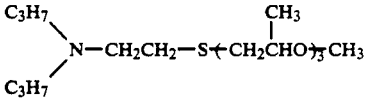
II-26
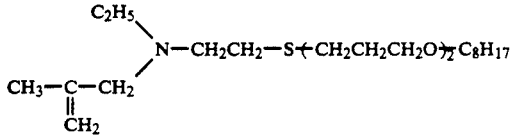
II-27
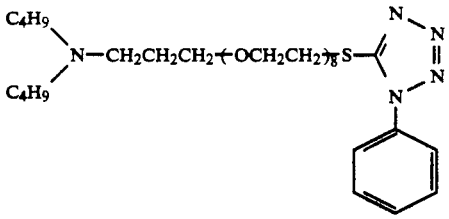
II-28
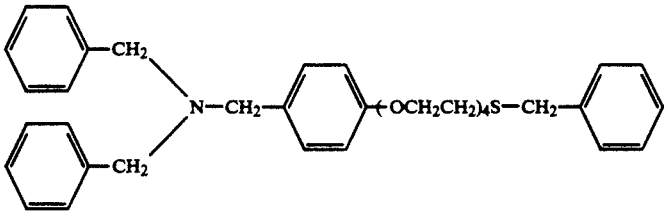
II-29
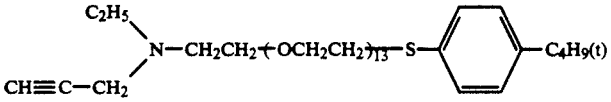

-continued

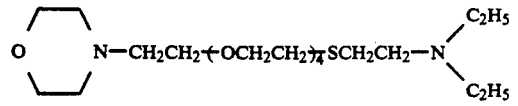

II-30

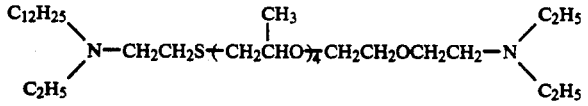

II-31

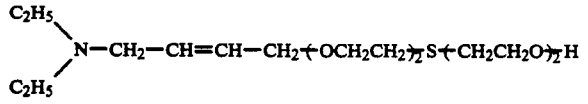

II-32

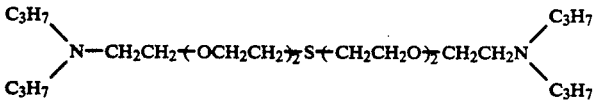

II-33

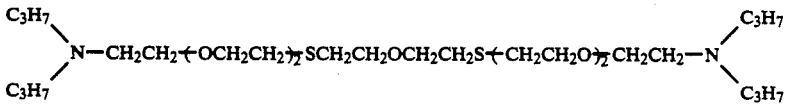

II-34

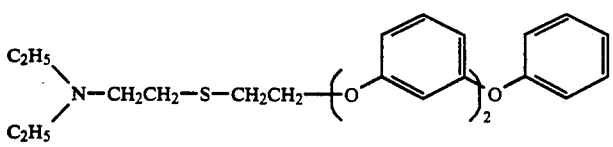

II-35

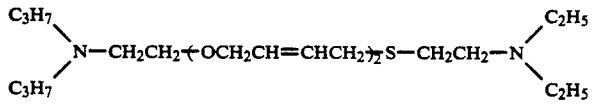

II-36

Next, we will show synthesized agents of the compounds illustrated by Formula II.

For example, compound II-3 is synthesized by means of the following synthesizing method.

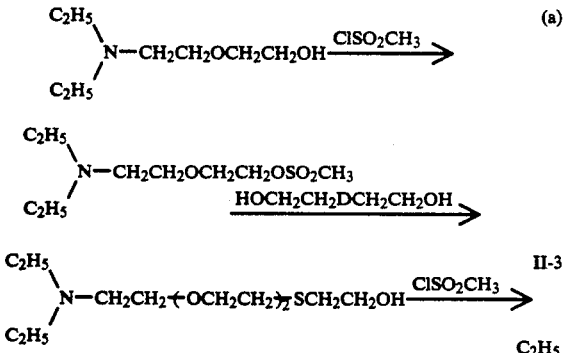

(a)

II-3

-continued

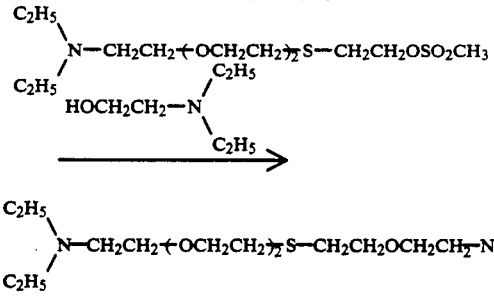

For example, compound II-4 can be synthesized employing a synthesized intermediate (a) of the above-mentioned II-3.

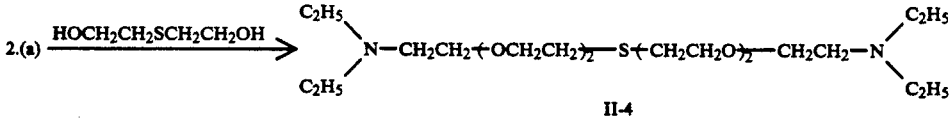

II-4

The content of compounds represented by Formula I or Formula II in the present invention are preferably $5\times10^{-7}$ to $5\times10^{-1}$ mol per mol of silver halide. Especially, it is preferable within the range of $5\times10^{-6}$ to $5\times10^{-2}$.

In the present invention, when compounds represented by Formula I or Formula II are contained in a photographic light-sensitive material, they are contained in silver halide emulsion layers or hydrophilic colloidal layers adjacent to said silver halide emulsion layers.

Here, compounds represented by Formula I or Formula II may be contained in the same layers as for hydrazine compounds, or they may be contained in different layers.

As hydrazine compounds used in the present invention, those represented by Formula III are preferable.

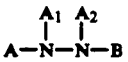

Formula III wherein A represents an aliphatic group, an aromatic group or a heterocyclic group; B represents an acyl group, an alkylsulfonyl group, an arylsulfonyl group, an alkylsulfinyl group, an arylsulfinyl group, a carbamoyl group, an alkoxycarbonyl group, an aryloxycarbonyl group, a sulfamoyl group, a sulfinamoyl group, an alkoxysulfonyl group, a thioacyl group, a thiocarbamoyl group, an oxalyl group or a heterocyclic group; both $A_1$ and $A_2$ represent hydrogen atoms, or one of them is a hydrogen atom while the other of them is an acyl group, a sulfonyl group or an oxalyl group, wherein B, $A_2$ and a nitrogen atom bonded with B and $A_2$ may form a partial structure of a hydrazone shown below.

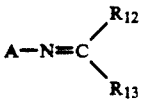

Hereunder, we will explain Formula III further in detail.

An aliphatic group represented by A is preferably those having 1 to 30 carbons, especially straight-chained, branched-chained or ring alkyl groups having 1 to 20 carbons. For example, a methyl group, an ethyl group, a t-butyl group, an octyl group, a cyclohexyl group and a benzyl group are cited, which may be substituted with appropriate substituents (for example, an aryl group, an alkoxyl group, an aryloxy group, an alkylthio group, an arylthio group, a sulfoxy group, a sulfonamide group, an acylamino group and an ureido group).

The preferable aromatic groups represented by A in Formula III are aryl groups of mono-ring or condensed-ring. For example, a benzene ring or a naphthalene ring may be cited.

As a heterocyclic group represented by A in Formula III, the preferable are heterocycles of mono-ring or condensed ring containing a hetero atom selected from at least one of nitrogen, sulfur and oxygen. For example, pyrrolidine, imidazole, tetrahydrofuran, morpholine, pyridine, pyrimidine, quinoline, thiazole, benzothiazole, thiophene and furan may be cited.

As A, the especially preferable, are an aryl group and a heterocyclic group.

A, an aryl group and a heterocyclic group, may have a substituent. As typical substituents, an alkyl group (preferably having 1 to 20 carbons), an aralkyl group (preferably those of mono-ring or condensed ring having 1 to 3 carbons at alkyl portion), an alkoxyl group (preferably having 1 to 20 carbons at alkyl portion), substituted amino group (preferably amino group substituted with an alkyl group or an alkylidene groups having 1 to 20 carbons), an acylamino group (preferably having 1 to 40 carbons), a sulfonamide groups (preferably having 1 to 40 carbons), an ureido group (preferably having 1 to 40 carbons), a hydrazinocarbonylamino group (preferably those having 1 to 40 carbons), a hydroxyl group and a phosphoamide group (preferably having 1 to 40 carbons) is cited.

B represents an acyl group (for example, a formyl group, an acetyl group, a propionyl group, a trifluoroacetyl group, a methoxyacetyl group, a phenoxyacetyl group, a methylthioacetyl group, a chloroacetyl group, a benzoyl group, a 2-hydroxymethylbenzoyl group and a 4-chlorobenzoyl group), an alkylsulfonyl group (for example, a methanesulfonyl group and a 2-chloroethanesulfonyl group), an arylsulfonyl group (for example, a benzenesulfonyl group), an alkylsulfinyl group (for example, a methanesulfinyl group), an arylsulfinyl group (for example, a benzenesulfinyl group), an carbamoyl group (for example, a methylcarbamoyl group and a phenylcarbamoyl group), an alkoxycarbonyl group (for example, a methylcarbonyl group and a methoxyethoxycarbonyl group), an aryloxycarbonyl group (for example, a phenoxycarbonyl group), a sulfamoyl group (for example, a dimethylsulfamoyl group), a sulfinamoyl group (for example, a methylsulfinamoyl group), an alkoxysulfonyl group (for example, a methoxysulfonyl group), a thioacyl group (for example, a methylthiocarbonyl group), a thiocarbamoyl group (for example, a methylthio carbamoyl group), a thiocarbamoyl group (for example, a methylthiocarbamoyl group), an oxalyl group (mentioned later in relation to Formula II) or a heterocyclic group is cited.

B in Formula III may form

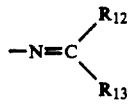

together with $A_2$ and a nitrogen atom with which B and $A_2$ couple together.

$R_{12}$ represents an alkyl group, an aryl group or a heterocyclic group. $R_{13}$ represents a hydrogen atom, an alkyl group, an aryl group or a heterocyclic group.

As B, an acyl group or an oxalyl group are especially preferable.

Both $A_1$ and $A_2$ are hydrogen atoms, or one of them is a hydrogen atom while the other is an acyl group (for example, an acetyl group, a trifluoroacetyl group and a benzoyl group), a sulfonyl group (a methanesulfonyl group and a toluenesulfonyl group) or an oxalyl group (an ethoxalyl group).

The particularly preferable of the hydrazine compounds used in the present invention are those illustrated by the following Formula IV.

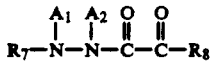

Formula IV wherein $R_7$ represents an aryl group or a heterocyclic group; $R_8$ represents

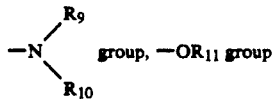

$R_9$ and $R_{10}$ each independently represent a hydrogen atom, an alkyl group, an alkenyl group, an alkynyl group, an aryl group, a heterocyclic group, an amino group, a hydroxyl group, an alkoxy group, an alkenyloxy group, an alkynyloxy group, an aryloxy group or a heterocyclicoxy group. $R_{11}$ represents a hydrogen atom, an alkyl group, an alkenyl group, an alkynyl group, an aryl group or a heterocyclic group. $A_1$ and $A_2$ represent the same group as $A_1$ and $A_2$ in Formula III.

We will explain Formula IV further in detail.

As aryl groups represented by $R_7$, those of mono-ring or condensed ring are preferable. For example, benzene or naphthalene may cited.

As a heterocycle represented by $R_7$, 5-membered or 6-membered unsaturated heterocycles of mono-ring or condensed ring containing at least one hetero atom selected from nitrogen, sulfur and oxygen are preferable. For example, pyridine, quinoline, pyrimidine, thiophene, furan, thiazole or benzothiazole are cited.

As $R_7$, the preferable is an aryl group, and those having a benzene ring are most preferable.

$A_1$ and $A_2$ represent the same group as $A_1$ and $A_2$ in Formula III. Both are preferable to be hydrogen atoms.

$R_8$ represents

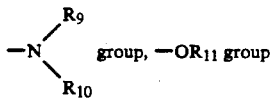

Here, $R_9$ and $R_{10}$ each independently represent a hydrogen atom, an alkyl group (for example, a methyl group, an ethyl group and a benzyl group), an alkenyl group (for example, an allyl group and a butenyl group), an alkynyl group (for example, a propargyl group and a butynyl group), an aryl group (for example, a phenyl group and a naphtyl group), a heterocyclic group (for example, 2,2,6,6-tetramethylpiperidinyl group, a N-benzylpiperidinyl group, a quinuclidinyl group, a N,N'-diethylpyrazolyzynyl group, a N-benzylpyrrolidinyl group and a pyridyl group), an amino group (for example, an amino group, a methylamino group, a dimethylamino group and a dibenzylamino group), a hydroxyl group, an alkoxyl group (for example, a methoxy group and an ethoxy group), an alkenyloxy group (for example, an allyloxy group), an alkynyloxy group (for example, a propargyloxy group), an aryloxy group (for example, a phenoxy group) or a heterocyclicoxy group (for example, a pyridyloxy group). $R_9$ and $R_{10}$ may form a ring (for example, piperidine and morpholine) together with a nitrogen atom. $R_{11}$ represents a hydrogen atom, an alkyl group (for example, a methyl group, an ethyl group, a methoxyethyl group and a hydroxyethyl group), an alkenyl group, (for example, an allyl group and a butenyl group), an alkynyl group (for example, a propargyl group and a butenyl group), an aryl group (for example, a phenyl group and a naphtyl group) and a heterocyclic group (for example, a 2,2,6,6-tetramethylpiperidinyl group, a N-methylpiperidinyl group and a pyridyl group).

Hereunder, we will show practical examples of Formula III.

III-1

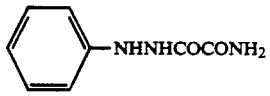

III-2

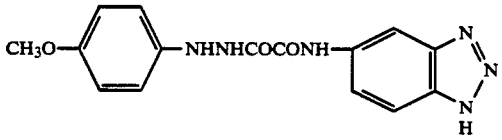

III-3

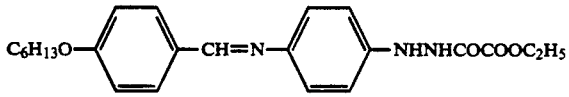

III-4

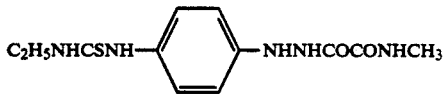

III-5

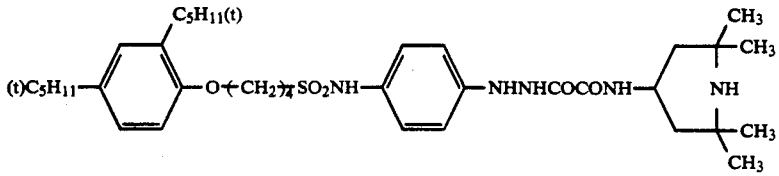

-continued
III-6
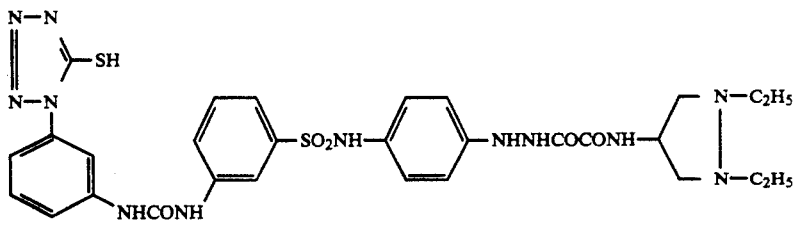
III-7
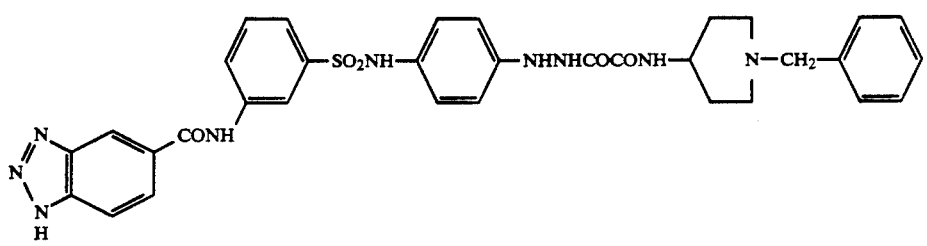
III-8
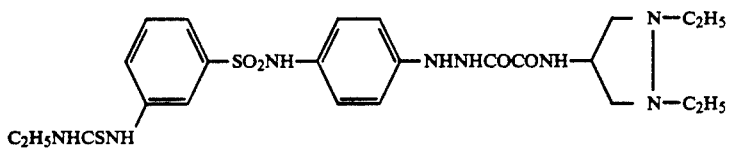
III-9
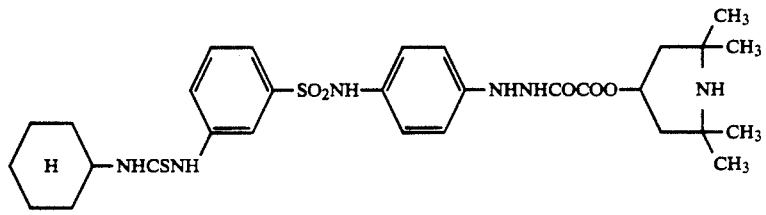
III-10
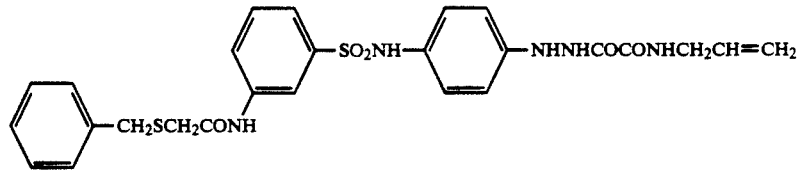
III-11
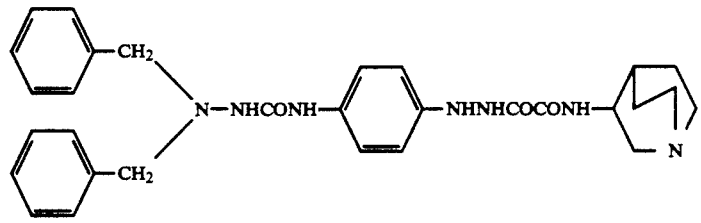
III-12
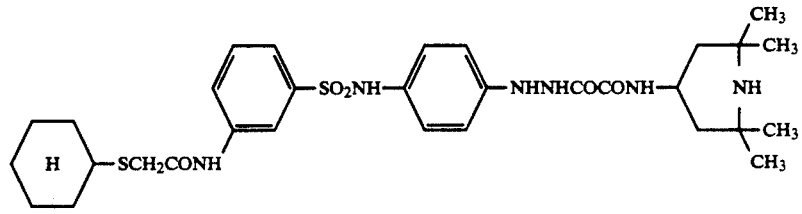

-continued
III-13
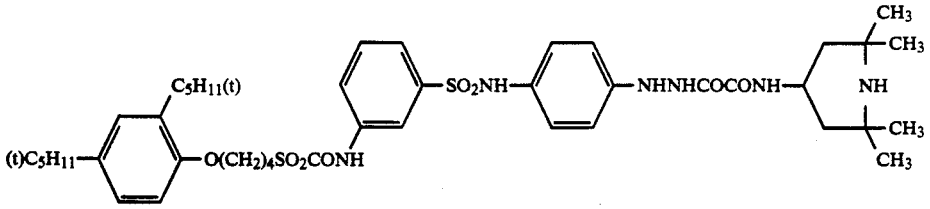
III-14
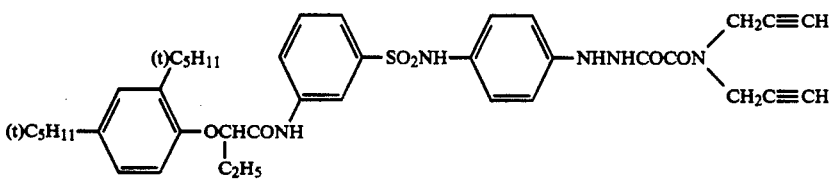
III-15
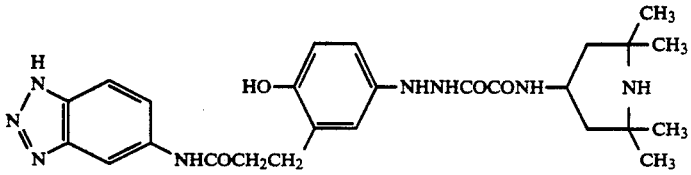
III-16
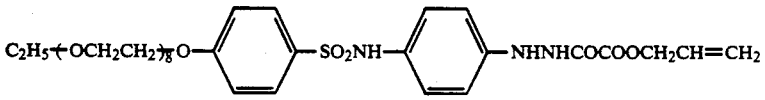
III-17
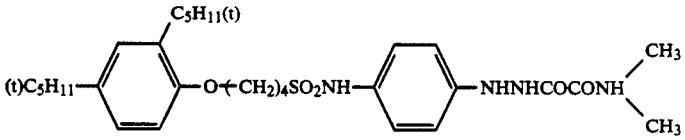
III-18
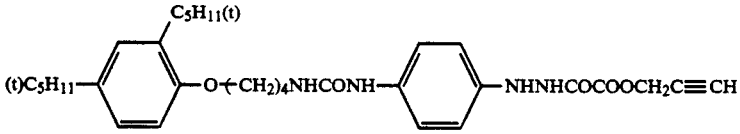
III-19
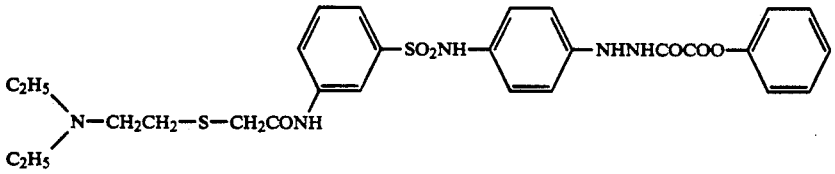
III-20
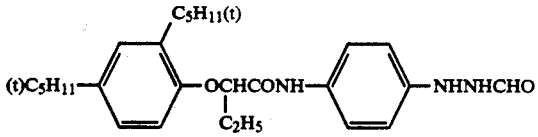
III-21
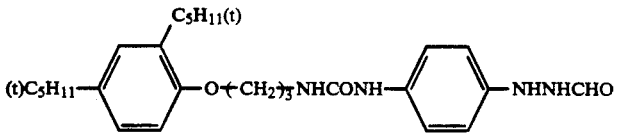

-continued
III-22
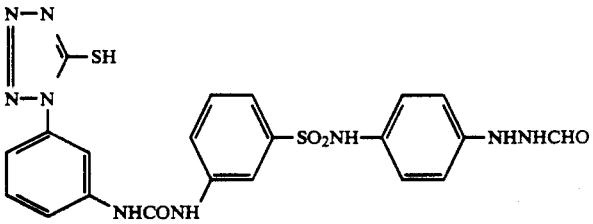
III-23
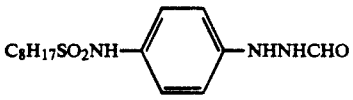
III-24
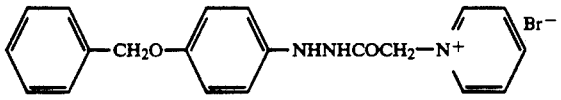
III-25
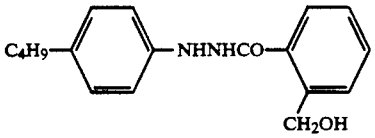
III-26
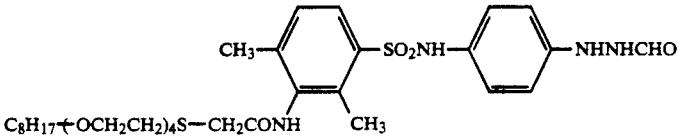
III-27
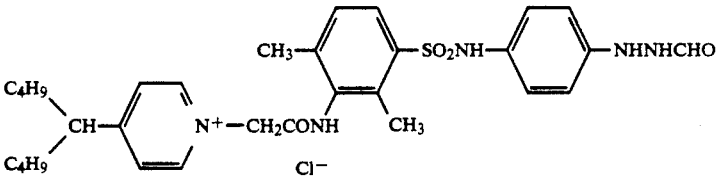
III-28
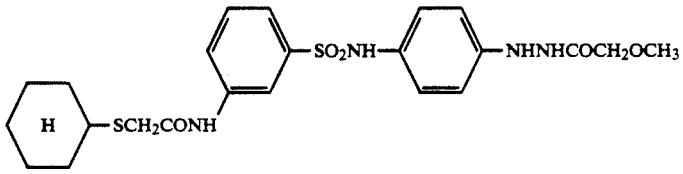
III-29
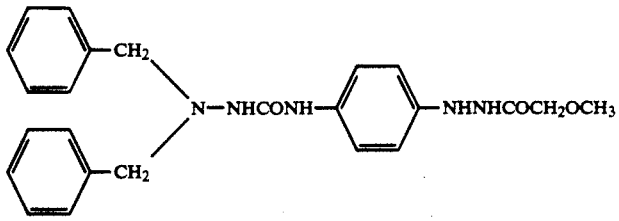
III-30
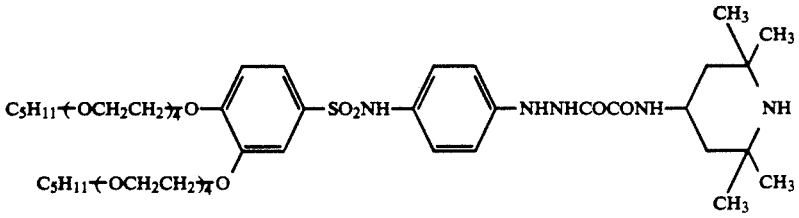

-continued
III-31
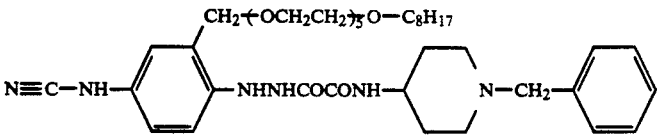
III-32
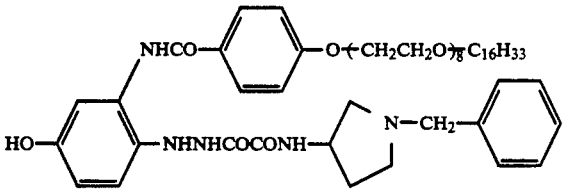
III-33
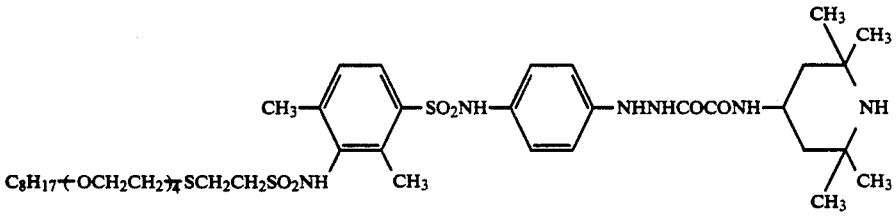
III-34
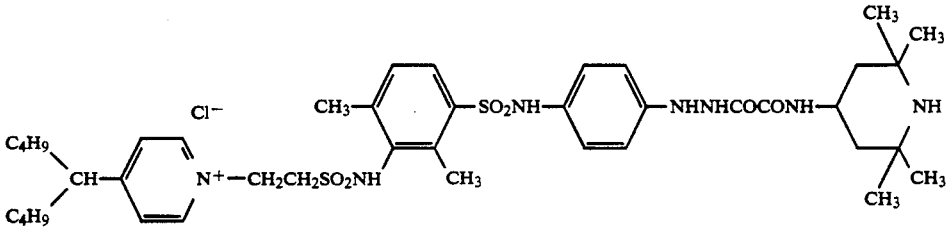
III-35
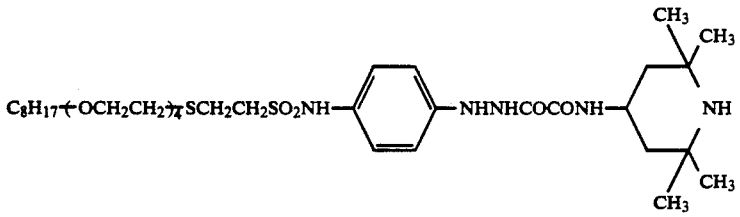
III-36
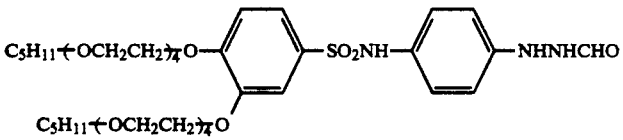
III-37
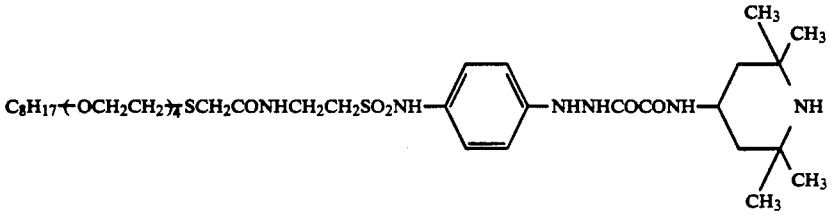

-continued

III-38

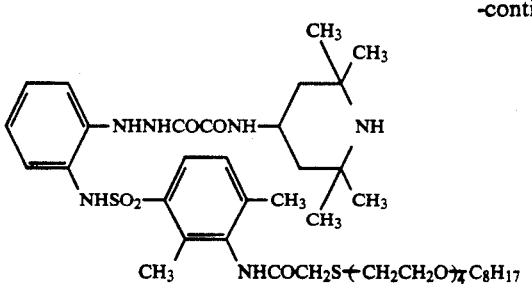

III-39

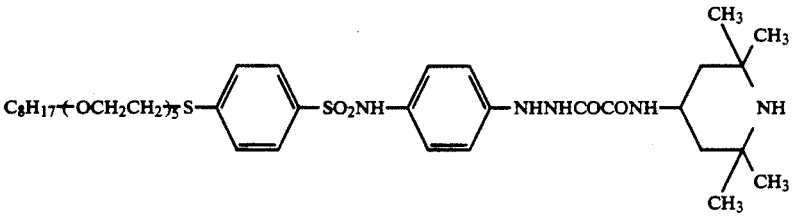

III-40

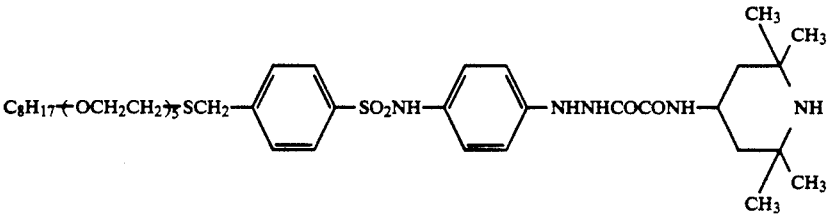

Compounds represented by Formula III in the present invention can be synthesized with reference to methods described in Japanese Patent O.P.I. Publication Nos. 180361/1987, 178246/1987, 234245/1988, 234246/1988, 90439/1989, 37/1990, 841/1990, 947/1990, 120736/1990, 230233/1990 and 125134/1991, U.S. Pat. Nos. 4,686,167, 4,988,604 and 4,994,365 and European Patent Nos. 253,665 and 333,435.

Content of compounds represented by Formula III in the present invention is preferably $5\times10^{-7}$ to $5\times10^{-1}$ mol per mol of silver halide and more preferably $5\times10^{-6}$ to $5\times10^{-2}$ mol.

In the present invention, when compounds represented by Formula III are contained in a photographic light-sensitive material, they are contained in a silver halide emulsion layer or a hydrophilic colloidal layer adjacent to said silver halide emulsion layer.

A silver halide photographic light-sensitive material in the present invention has at least one silver halide emulsion layer. At least one silver halide emulsion layer may be provided on one side of support, or at least one layer may be provided on each of both sides of the support. This silver halide emulsion can be coated on a support directly or it can be coated on a support through another layer, for example, a hydrophilic colloidal layer not containing a silver halide emulsion. In addition, on a silver halide emulsion layer, a hydrophilic colloidal layer as a protective layer may be coated. In addition, a silver halide emulsion layer may be coated in the form of different kinds of silver halide emulsion layers, for example, a high sensitive silver halide emulsion layer and a low sensitive silver halide emulsion layer. In such a case, an intermediate layer may be provided between silver halide emulsion layers. Namely, an intermediate layer composed of hydrophilic colloid can be provided, if necessary. In addition, between a silver halide emulsion layer and a protective layer, nonsensitive hydrophilic colloidal layers such as an intermediate layer, a protective layer, an anti-halation layer and a backing layer may be provided.

Next, we will explain silver halide used for a silver halide photographic light-sensitive material in the present invention. As silver halide, silver chloroiodidobromide containing silver iodide of 4 mol % or less, preferably silver iodide of 3 mol % or less or silver iodobromide may be used. The average grain size of the above-mentioned silver halide is preferable to be 0.05 to 0.5 μm, and most preferable to be 0.10 to 0.40 μm.

Though the dispersion of grain sizes of silver halide grains used in the present invention is arbitrary, it is adjusted so that the value of mono-dispersion degree defined below is in the range of 1 to 20% preferably and 5 to 15% more preferably.

Here, mono dispersion degree is defined as a value (%) wherein the standard deviation of grain size is divided by the average grain size and the quotient therefrom is multiplied by 100. The grain size of silver halide grain is, for convenience' sake, represented by the edge length for a cubic crystal grain and is calculated using the square root of projected area for other grains (octahedron, tetrahedron and so on).

In working of the present invention, silver halide grains each having 2 layers of multi layer lamination structure can be used. For example, those composed of silver iodobromide in the core portion and silver bromide in the shell portion thereof can be used. In such a case, iodine can be contained in arbitrary layers in quantity of 5 mol % or less.

To silver halide grains used for a silver halide emulsion in the present invention, metal ion can be added employing at least one selected from cadmium salts, zinc salts, lead salts, thallium salts, iridium salts (including their complex salts), rhodium salts (including their complex salts) and iron salts (including their complex salts) in the course of forming grains and/or growing grains so that the above-mentioned metal element may be contained in the inside and/or the surface of the grain. In addition, by placing them under reducing condition, reductive sensitization nucleus can be provided in the inside and/or on the surface of grains.

In addition, silver halide can be sensitized by means of various chemical sensitizers. As sensitizers, for example, active gelatin, sulfur sensitizers (sodium thiosulfate, allylthiocarbamide, thiourea and allylisothiacynate), selenium sensitizers (N,N-dimethylselenourea and selenourea), reduction sensitizers (triethylenetetramine and stannous chloride) and various noble metal sensitizers can be used independently, or in combination of 2 or more of them. When a gold sensitizer is used, ammonium rhodanide can be used as an auxiliary agent.

Since silver halide grains used in the present invention can preferably be used for grains wherein inside sensitivity for each grain is higher than that on the surface thereof, so-called silver halide grains providing negative images, the performance thereof can be improved by processing with the above-mentioned chemical sensitizers.

In addition, silver halide emulsions used in the present invention can be subjected to stabilization or fog-restraining through the use of a mercapto group (for example, 1-phenyl-5-mercaptotetrazole and 2-mercaptobenzthiazole), a benzotriazole group (5-bromobenzotriazole, 5-methylbenzotriazole) and a benzoimidazole group (6-nitrobenzoimidazole).

To light-sensitive silver halide emulsion layers or adjacent layers thereof, compounds described in Items B to D of Item XXI of Research Disclosure Vol. 17463 can be added for the purpose of enhancing sensitivity, enhancing contrast or accelerating development.

In addition, compounds represented by the following Formula P are preferable to be added.

$$R_{11}—O—(CH_2CH_2O)nH$$

wherein $R_{11}$ represents a hydrogen atom or an aromatic ring having an unsubstituted or a substituted group; n represents an integer of 10 to 200.

As practical examples of compounds represented by Formula P, P-1 to P-17 described on pp. 94 to 96 of Japanese Patent Application No. 160939/1990 are preferable. Of them, the molecular weight is preferable to be not less than 1500.

The above-mentioned compounds are on the market and are easily available. They are preferable to be added by 0.01 to 0.4 mol in quantity per mol of silver halide, and more preferable to be added at 0.02 to 2 mol. In addition, it is allowed to contain 2 or more compounds having different n values.

To a silver halide emulsion used in the present invention, a sensitizing dye, a plasticizer, an anti-static agent, a surfactant and a hardener can also be added.

When compounds of Formulae I, II and III in the present invention are added to hydrophilic colloidal layers, gelatin is preferably used for a binder to the hydrophilic colloidal layer. Hydrophilic colloids other than gelatin can also be used. The above-mentioned hydrophilic binders are preferable to be coated at 10 $g/m^2$ or less on both side of support.

As a support capable of being used in working of the present invention, for example, a baryta paper, a polyethylene-laminated paper, a polypropyrene-synthesized paper, a glass plate, cellulose acetate, cellulose nitrate and polyester films such as polyethylene terephthalate can be cited. The above-mentioned supports are selected appropriately depending upon the purpose of application of each silver halide photographic light-sensitive material.

When a silver halide photographic light-sensitive material in the present invention is developed, the following developing agents are used.

A typical HO—(CH=CH)n—OH type developing agent is hydroquinone. In addition, catechol and pyrogallol are used.

In addition, as a HO—(CH=CH)n—$NH_2$ type developing agent, ortho and para aminophenols or aminopyrazolones are typical. N-methyl-p-aminophenol, N-β-hydroxyethyl-p-aminophenol, p-hydroxyphenylamino acetate and 2-aminonaphthol are cited.

As heterocycle type developing agents, 3-pyrazolidone types such as 1-phenyl-3-pyrazolidone, 1-phenyl-4,4-dimethyl-3-pyrazolidone, 1-phenyl-4-methyl-4-hydroxymethyl-3-pyrazolidone and 1-phenyl-4-methyl-4-hydroxymethyl-3-pyrazolidone are cited.

In addition, developing agents described on pp. 291 to 334 of The Theory of the Photographic Process, Fourth Edition and page 3,100 of Journal of the American Chemical Society Volume 73 (1951) can effectively be employed in the present invention. The above-mentioned developing agents may be used independently, or 2 or more of them may be used in combination. However, it is preferable to use 2 or more of them in combination.

Even when sulfites such as soda sulfite and potassium sulfite are used as a preserver for a developing solution used for developing a light-sensitive material in the present invention, the effect of the present is not damaged. In addition, hydroxylamine and hydrazide compounds may also be used as preservers. In addition, functions of pH adjustment and buffering employing caustic alkali, alkali carbonate and amine as used in conventional black-and-white developing solution can be provided.

As developing solutions used in the present invention, it is noticeable that those having pH of less than 11 can be used. In addition, to the developing solutions, it is arbitrary to add inorganic development inhibitor such as potassium bromide, organic development inhibitor such as 5-methylbenzotriazole, 5-methylbenzoimidazole, 5-nitroindazole, adenine, guanine and 1-phenyl-5-mercaptotetrazole, scavengers for metal ion such as ethylenediamine tetraactate, development accelerators such as methanol, ethanol, benzylalcohol and polyalkyleneoxide, surfactants such as sodium alkylarylsulfonate, natural saponin, sugar, alkylester compounds of the above-mentioned compound, hardeners such as glutaric aldehyde, formalin and glyoxal and adjuster of ion strength such as sodium sulfate.

To developing solutions used in the present invention, as organic solvents, alkanolamine group such as diethanolamine and triethanolamine, glycol group such as diethylene glycol and triethyleneglycol and alkylaminoalcohol group such as diethylamino-1,2-propanediol and butylaminopropanol may be contained.

EXAMPLE

The following examples serves to illustrate the practice of the invention.

However, it should be understood that the present invention is by no means restricted to such specific examples.

EXAMPLE 1

Preparation of Silver Halide Emulsion A

By means of the double jet method, silver iodobromide emulsion (having silver iodide of 2 mol % per mol of silver) was prepared. In this mixing, $8\times10^{-7}$ mol of $K_2IrCl_6$ were added per mol of silver.

The obtained emulsion was composed of cubic monodispersed grains (the coefficient of variation was 9.5%) having an average grain size of 0.20 μm. To the above-mentioned emulsion, 6.5 ml of 1% potassium iodide aqueous solution was added per mol of silver. Then, degenerated gelatin (an illustrated compound G-8 described in Japanese Patent Application No. 180787/1989). The solution was washed and desalted in the same manner as Example 1 of Japanese Patent Application No. 180787/1989. pAg of the solution at 40° C. after subjected to desalting was 8.0. In addition, when the solution was subjected to dispersing again, the mixture of the following compounds [A], [B]and [C] were added as an antibacteria agent.

[A]

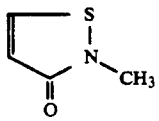

[B]

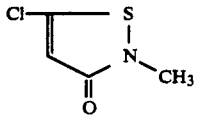

[C]

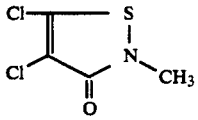

Preparation of Silver Halide Photographic Light-sensitive Material

On one side of subbing layer (detailed in Example 1 of Japanese Patent Application No. 1994/1984) having thickness of 0.1 μm provided on both side of polyethylene terephthalate film having thickness of 100 μm, a silver halide emulsion layer shown in composition (1) was coated so that the amount of gelatin was 2.0 g/m² and the content of silver was 3.2 g/m². In addition, an emulsion protective layer shown in composition (2) was coated thereon so that the amount of gelatin was 1.0 g/m². On the other subbing layer rear side, a backing layer having the following composition (3) was coated so that the amount of gelatin was 2.4 g/m². In addition, a backing protective layer having the following composition (4) was coated thereon so that the content of gelatin was 1.0 g/m². Thus, the samples 1 to 30 were prepared.

| Composition (1) (silver halide emulsion layer) | |
|---|---|
| Gelatin | 2.0 g/m² |
| Silver halide emulsion A (content of silver) | 3.2 g/m² |
| Sensitizing dye: SD-1 | 8.0 mg/m² |
| Sensitizing dye: SD-2 | 0.2 mg/m² |
| Stabilizer: 4-methyl-6-hydroxy-1,3,3a,7-tetrazaindene | 30 mg/m² |
| Anti-foggant: Adenine | 10 mg/m² |
| Surfactant: Saponin | 0.1 g/m² |
| Surfactant: S-1 | 8.0 mg/m² |
| Hydrazine derivative in the invention | 30 mg/m² |
| Contrast-promoting compound in the invention | 100 mg/m² |
| Latex polymer: LX | 1.0 g/m² |
| Polyethylene glycol (the molecular weight is 4000) | 0.1 g/m² |
| Hardener: H-1 | 60 mg/m² |

| Composition (2) (emulsion protective layer) | |
|---|---|
| Gelatin | 1.0 g/m² |
| Surfactant: S-2 | 10 mg/m² |
| Matting agent: Silica having an average grain size of 3.5 μm | 3 mg/m² |
| Hardener: Formalin | 30 mg/m² |
| Surfactant: S-3 | 10 mg/m² |

| Composition (3) (backing layer) | |
|---|---|
| D-1 | 30 mg/m² |
| D-2 | 75 mg/m² |
| D-3 | 30 mg/m² |
| Gelatin | 2.4 g/m² |
| Surfactant: S-1 | 6.0 mg/m² |
| Surfactant: Saponin | 0.1 g/m² |

| Composition (4) (backing protective layer) | |
|---|---|
| Gelatin | 1 g/m² |
| Matting agent: polymethylmethacrylate having an average grain size of 3.0 to 5.0 μm | 15 mg/m² |
| Surfactant: S-2 | 10 mg/m² |
| Hardener: glyoxal | 25 mg/m² |
| Hardener: H-1 | 35 mg/m² |

Compounds used in Compositions (1), (2) and (3) are shown as follows.

SD-1

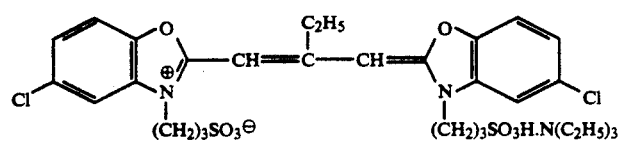

SD-2

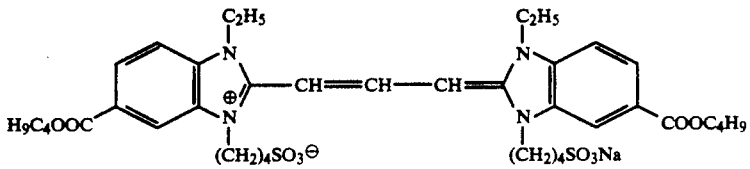

-continued

S-1

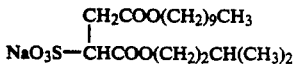

LX

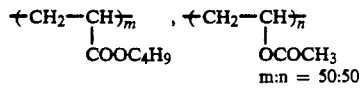

H-1

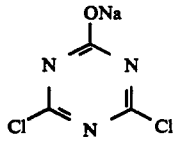

S-2

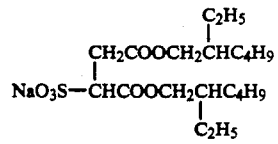

S-3

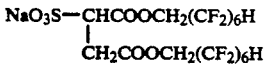

D-1

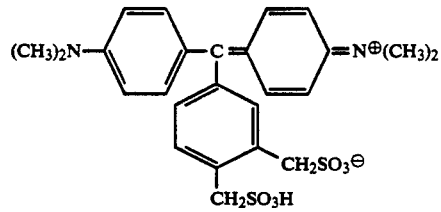

D-2

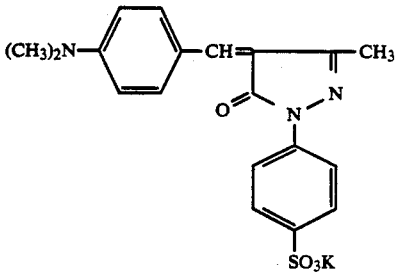

D-3

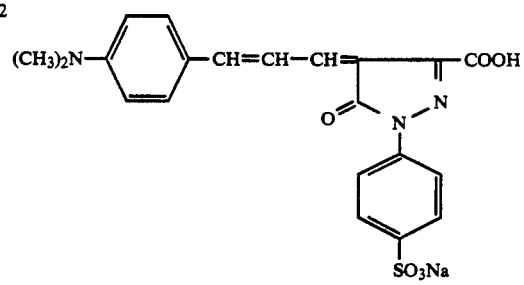

The obtained samples were subjected to dots quality test employing the following method.

The Method of Examination of Dot Quality

A contact dot screen having an dot area of 50% (150 lines/inch) were provided on a step wedge partially, to which a sample was contacted and subjected to exposure for 5 seconds by means of Xenon electric source. The above-mentioned sample was subjected to development processing under the following conditions employing an automatic developing machine for rapid processing use to which the following developing solution and the following fixing solution were charged. Then, the dot quality of sample was observed with a loupe with a 100=power magnifier. The supreme dot quality was ranked as "5", and the others were ranked as "4", "3", "2" and "1" as the quality was degraded in this order.

The ranks 1 and 2 each represent a level of no practical use.

In addition, fogging in dots were evaluated in the same manner. Those wherein pepper fog did not occur in dots at all were ranked as the supreme "5". Depending upon the degree of occurrence of pepper fog occurred in dots, they were ranked as "4", "3", "2" and "1" wherein the evaluations were degraded as the numerals were decreased.

Incidentally, in ranks "1"and "2", pepper fog are so large that they are not acceptable for practical use.

| | Developing solution 1 | Developing solution 2 |
|---|---|---|
| Composition of developing solution | | |
| Sodium salt ethylenediamine tetraacetate | 1 g | 1 g |

-continued

| | Developing solution 1 | Developing solution 2 |
|---|---|---|
| Sodium sulfite | 60 g | 60 g |
| Trisodium phosphate (dodecahydrate) | 75 g | 75 g |
| Hydroquinone | 22.5 g | 22.5 g |
| Sodium hydroxide | 8 g | 8 g |
| Sodium bromide | 3 g | 3 g |
| 5-methylbenzotriazole | 0.25 g | 0.25 g |
| 1-phenyl-5-mercaptotetrazole | 0.08 g | 0.08 g |
| Metol | 0.25 g | 0.25 g |
| Water to make | 1 l. | 1 l. |
| pH was adjusted with sodium hydroxide. | pH = 10.8 | pH = 10.5 |
| Composition of fixing solution | | |
| (Composition A) | | |
| Ammonium thiosulfate (aqueous solution of 72.5 w/v %) | 240 ml | |
| Sodium sulfite | 17 g | |
| Sodium acetate (trihydrate) | 6.5 g | |
| Boric acid | 6 g | |
| Sodium citrate (dihydrate) | 2 g | |
| (Composition B) | | |
| Pure water (ion-exchanged water) | 17 ml | |
| Sulfuric acid (aqueous solution of 50% w/w) | 4.7 g | |
| Aluminum sulfate | 26.5 g | |

Aqueous solution wherein reduced amount converted to $Al_2O_3$ is 8.1 w/w %.

When a fixing solution was used, the above-mentioned compositions A and B were dissolved in 500 ml of water in this order to make 1 l. pH of this fixing solution was adjusted to 4.8 with acetic acid.

| (Conditions for development) | | |
|---|---|---|
| (Step) | (Temperature) | (Time) |
| Developing | 40° C. | 15 seconds |
| Fixing | 35° C. | 15 seconds |

-continued

| (Step) | (Conditions for development) (Temperature) | (Time) |
|---|---|---|
| Washing | 30° C. | 10 seconds |
| Drying | 50° C. | 10 seconds |

As comparative compounds for the contrast-promoting compounds in the present invention added in the silver halide emulsion layer in Formula 1, the following Compounds (a) and (b) were added.

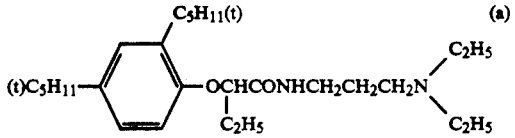

(a)

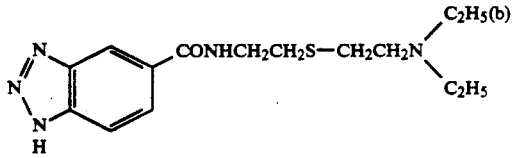

(b)

The results of quality test are shown in Table 1.

TABLE 1

| Sample No. | contrast-promoting compound | Hydrazine compound | Developing solution | Dot quality | Pepper fog | Note |
|---|---|---|---|---|---|---|
| 1 | — | — | 1 | 1 | 5 | Comparative |
| 2 | — | III-5 | 1 | 2 | 5 | Comparative |
| 3 | I-2 | — | 1 | 1 | 5 | Comparative |
| 4 | I-2 | III-5 | 1 | 4 | 4 | Invention |
| 5 | I-3 | III-8 | 1 | 4.5 | 4 | Invention |
| 6 | I-3 | III-8 | 2 | 4 | 4.5 | Invention |
| 7 | I-3 | III-12 | 1 | 5 | 4 | Invention |
| 8 | I-3 | III-12 | 2 | 4 | 4.5 | Invention |
| 9 | I-3 | III-22 | 1 | 4 | 3 | Invention |
| 10 | I-3 | III-22 | 2 | 3.5 | 4 | Invention |
| 11 | I-3 | III-29 | 1 | 3 | 4 | Invention |
| 12 | I-4 | III-8 | 1 | 4.5 | 4 | Invention |
| 13 | I-11 | III-12 | 1 | 5 | 4.5 | Invention |
| 14 | I-11 | III-12 | 2 | 4 | 5 | Invention |
| 15 | (a) | III-12 | 1 | 2.5 | 3 | Comparative |
| 16 | (a) | III-12 | 2 | 2 | 3.5 | Comparative |
| 17 | (b) | III-12 | 1 | 4 | 2 | Comparative |
| 18 | (b) | III-12 | 2 | 3 | 3 | Comparative |
| 19 | I-12 | III-12 | 1 | 4 | 4 | Invention |
| 20 | I-17 | III-16 | 1 | 4 | 4 | Invention |
| 21 | I-20 | III-5 | 1 | 4.5 | 4 | Invention |
| 22 | I-20 | III-5 | 2 | 4 | 5 | Invention |
| 23 | I-20 | III-12 | 1 | 5 | 4 | Invention |
| 24 | I-20 | III-12 | 2 | 4 | 5 | Invention |
| 25 | I-20 | III-18 | 1 | 3.5 | 5 | Invention |
| 26 | I-22 | III-8 | 1 | 4.5 | 4.5 | Invention |
| 27 | I-34 | III-12 | 1 | 5 | 4.5 | Invention |
| 28 | I-34 | III-12 | 2 | 4 | 5 | Invention |
| 29 | I-34 | III-16 | 1 | 4 | 5 | Invention |
| 30 | I-44 | III-5 | 1 | 4 | 4.5 | Invention |

As is apparent from Table 1, the samples in the present invention are superior to the comparative samples in dot quality and pepper fog.

EXAMPLE 2

Samples were prepared in the same manner as Example 1 except that the contrast-promoting compound represented by Formula [I] in (1) of Example 1 was replaced with contrast-promoting compound represented by Formula [II] in the present invention and compounds shown in the following (a) and (b) were employed as comparative compounds.

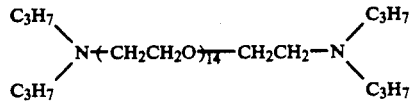

(a)

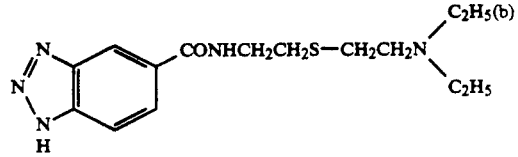

(b)

The results of quality test are shown in Table 2.

TABLE 2

| Sample No. | contrast-promoting compound | Hydrazine compound | Developing solution | Dot quality | Pepper fog | Note |
|---|---|---|---|---|---|---|
| 1 | (a) | III-12 | 1 | 4 | 2 | Comparative |
| 2 | (a) | III-12 | 2 | 3.5 | 2.5 | Comparative |
| 3 | (b) | III-12 | 1 | 4 | 2 | Comparative |
| 4 | (b) | III-12 | 2 | 3 | 3 | Comparative |
| 5 | II-3 | III-12 | 1 | 5 | 4 | Invention |
| 6 | II-3 | III-12 | 2 | 4.5 | 4.5 | Invention |
| 7 | II-3 | III-33 | 1 | 5 | 4.5 | Invention |
| 8 | II-3 | III-33 | 2 | 4.5 | 5 | Invention |

TABLE 2-continued

| Sample No. | contrast-promoting compound | Hydrazine compound | Developing solution | Dot quality | Pepper fog | Note |
|---|---|---|---|---|---|---|
| 9 | II-4 | III-12 | 1 | 5 | 4 | Invention |
| 10 | II-4 | III-12 | 2 | 4.5 | 4.5 | Invention |
| 11 | II-4 | III-22 | 1 | 4 | 3 | Invention |
| 12 | II-4 | III-22 | 2 | 3.5 | 4 | Invention |
| 13 | II-4 | III-39 | 1 | 5 | 4.5 | Invention |
| 14 | II-8 | III-5 | 1 | 4 | 4.5 | Invention |
| 15 | II-8 | III-12 | 1 | 4.5 | 4.5 | Invention |
| 16 | II-9 | III-12 | 1 | 5 | 4 | Invention |
| 17 | II-9 | III-12 | 2 | 4.5 | 4.5 | Invention |
| 18 | II-10 | III-12 | 1 | 4 | 4.5 | Invention |
| 19 | II-14 | III-12 | 1 | 4 | 4.5 | Invention |
| 20 | II-14 | III-39 | 1 | 4.5 | 4.5 | Invention |
| 21 | II-18 | III-5 | 1 | 4 | 5 | Invention |
| 22 | II-18 | III-33 | 1 | 4.5 | 4.5 | Invention |
| 23 | II-18 | III-33 | 2 | 4 | 5 | Invention |
| 24 | II-21 | III-12 | 1 | 4.5 | 4.5 | Invention |
| 25 | II-21 | III-35 | 1 | 4.5 | 4.5 | Invention |
| 26 | II-21 | III-35 | 2 | 4 | 5 | Invention |
| 27 | II-24 | III-8 | 1 | 4.5 | 4 | Invention |
| 28 | II-34 | III-30 | 1 | 5 | 4 | Invention |
| 29 | II-34 | III-30 | 2 | 4.5 | 5 | Invention |

As is apparent from Table 2, it turns out the samples in the present invention are superior to the comparative samples in dot quality and pepper fog.

What is claimed is:

1. A silver halide photographic light-sensitive material comprising a support having thereon at least one silver halide emulsion layer, a hydrazine compound being contained in said silver emulsion layer or at least one other layer, wherein said material contains at least one compound represented by Formula I or Formula II,

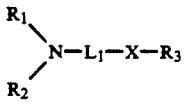

Formula I wherein $R_1$ and $R_2$ individually are alkyl, alkenyl, or alkynyl; $R_1$ and $R_2$ may form a ring; $R_3$ is hydrogen, alkyl, alkenyl, alkynyl, aryl or a heterocyclic group; $L_1$ is a divalent linking group; X is —[S—$L_2$—Y—($L_3$)n]— or [—($L_3$)n—Y—$L_2$—S—]—, wherein $L_2$ is alkylene or alkenylene, Y is carbonyl, sulfonyl, sulfoxy, or phosphoryl, and $L_3$ is

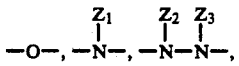

wherein $Z_1$, $Z_2$, and $Z_3$ individually are hydrogen, alkyl, alkenyl, alkynyl, aryl or a heterocyclic group; and n is an integer of 0 to 1;

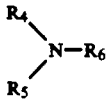

Formula II wherein $R_4$, $R_5$ and $R_6$ independently are alkyl, alkenyl or alkynyl, compounds of Formula II further comprising a thioether group and a group represented by —O—Y), wherein Y represents alkylene, alkenylene or arylene, and l is an integer of 2 or more.

2. The silver halide photographic light-sensitive material of claim 1, wherein the compound represented by Formula II is the compound selected from the group consisting of Formula II-A and Formula II-B,

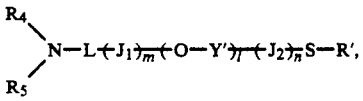

Formula II-A

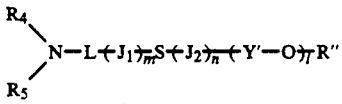

Formula II-B wherein $R_4$ and $R_5$ independently are alkyl, alkenyl or alkynyl, Y' is alkylene, alkenylene or arylene, l is an integer of 2 or more, m and n are independently 0 or 1, L is a divalent aliphatic group, $J_1$ and $J_2$ individually are divalent linking groups, R' is an aliphatic group, an aromatic group, or a heterocyclic group, and R'' is hydrogen, an aliphatic group, an aromatic group or a heterocyclic group.

3. The silver halide light-sensitive material of claim 1, wherein said hydrazine compound is represented by Formula III,

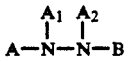

Formula III wherein A represents an aliphatic group, an aromatic group or a heterocyclic group, B represents an acyl group, an alkylsulfonyl group, an arylsulfonyl group, an alkylsulfinyl group, an arylsulfinyl group, a carbamoyl group, an alkoxycarbonyl group, an aryloxycarbonyl group, a sulfamoyl group, a sulfinamoyl group, an alkoxysulfonyl group, a thioacyl group, a thiocarbamoyl group, an oxalyl group or a heterocyclic group, $A_1$ and $A_2$ both represent hydrogen atoms, or one of them represents a hydrogen atom and the other represents an acyl group, a sulfonyl group or an oxalyl group, wherein B, $A_2$ and a nitrogen atom bonded with B and $A_2$ may form a hydrazone structure represented by

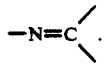

4. The silver halide photographic light-sensitive material of claim 1, wherein said hydrazine compound is represented by Formula IV,

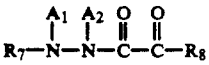

Formula IV wherein $R_7$ represents an aryl group or a heterocyclic group, $R_8$ represents a

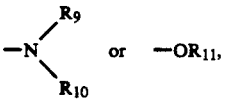

wherein $R_9$ and $R_{10}$ each independently represents a hydrogen atom, an alkyl group, an alkenyl group, an alkynyl group, an aryl group, a heterocyclic group, an amino group, a hydroxyl group, an alkoxyl group, an alkenyloxy group, an alkynyloxy group, an aryloxy group or a heterocyclicoxy group, $R_{11}$ represents a hydrogen atom, an alkyl group, an alkenyl group, an alkynyl group, an aryl group or a heterocyclic group, $A_1$ and $A_2$ both represent hydrogen atoms, or one of them represents a hydrogen atom and the other represents an acyl group, a sulfonyl group or an oxalyl group.

5. The silver halide photographic light-sensitive material of claim 1, wherein the content of a compound represented by Formula I or Formula II is within the range of $5\times10^{-7}$ to $5\times10^{-1}$ mol/mol silver halide.

6. The silver halide photographic light-sensitive material of claim 1, wherein a compound represented by Formula I or Formula II is contained in said silver halide emulsion layer or a hydrophilic colloidal layer adjacent to said silver halide emulsion layer.

7. A silver halide photographic light-sensitive material comprising a support having thereon at least one silver halide emulsion layer, a hydrazine compound being contained in said silver emulsion layer or at least one other layer, wherein said material contains at least one compound represented by Formula I, Formula II-A or Formula II-B,

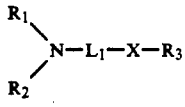

Formula I wherein $R_1$ and $R_2$ individually are alkyl, alkenyl, or alkynyl; $R_1$ and $R_2$ may form a ring; $R_3$ is hydrogen, alkyl, alkenyl, alkynyl, aryl, or a heterocyclic group; $L_1$ is a divalent combination group; X is —[S—$L_2$—Y—$(L_3)$n]— or [—$(L_3)$n—Y—$L_2$—S—]—, wherein $L_2$ is alkylene or alkenylene, Y is carbonyl, sulfonyl, sulfoxy, or phosphoryl, and $L_3$ is

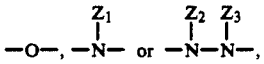

wherein $Z_1$, $Z_2$, and $Z_3$ independently represent hydrogen, alkyl, alkenyl, alkynyl, aryl, or a heterocyclic group; n is an integer of 0 to 1,

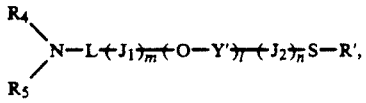

Formula II-A

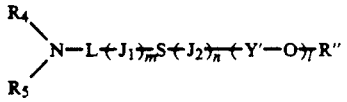

Formula II-B wherein $R_4$ and $R_5$ individually are alkyl, alkenyl, or alkynyl, Y' is alkylene, alkenylene, or arylene, l is an integer of 2 or more, m and n are independently 0 or 1, L is a divalent aliphatic group, $J_1$ and $J_2$ are individually divalent linking groups, R' is an aliphatic group, an aromatic group, or a heterocyclic group, and R'' is hydrogen, an aliphatic group, an aromatic group, or a heterocyclic group.

* * * * *